US011180230B2

(12) United States Patent
Fawcett et al.

(10) Patent No.: US 11,180,230 B2
(45) **Date of Patent: *Nov. 23, 2021**

(54) DISPOSABLE INFLATOR

(71) Applicant: Halkey-Roberts Corporation, St. Petersburg, FL (US)

(72) Inventors: Lyman Fawcett, St. Petersburg, FL (US); Taylor Breau, St. Petersburg, FL (US)

(73) Assignee: Halkey-Roberts Corporation, St. Petersburg, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/983,560

(22) Filed: Aug. 3, 2020

(65) Prior Publication Data

US 2021/0024187 A1 Jan. 28, 2021

Related U.S. Application Data

(63) Continuation-in-part of application No. 16/440,759, filed on Jun. 13, 2019, now Pat. No. 10,730,595.

(60) Provisional application No. 62/693,022, filed on Jul. 2, 2018, provisional application No. 62/684,725, filed on Jun. 13, 2018.

(51) Int. Cl.

| | |
|---|---|
| ***B63C 9/19*** | (2006.01) |
| ***B60C 29/00*** | (2006.01) |
| ***B63C 9/00*** | (2006.01) |

(52) U.S. Cl.

CPC ..... *B63C 9/19* (2013.01); *B63C 9/24* (2013.01); *B63C 2009/007* (2013.01); *B63C 2009/0035* (2013.01); *B63C 2009/0058* (2013.01)

(58) Field of Classification Search

CPC ..... B63C 9/19
USPC ..... 222/5
See application file for complete search history.

(56) References Cited

U.S. PATENT DOCUMENTS 2,662,502 A * 12/1953 Turner ..... A62C 13/003 116/273
3,059,814 A * 10/1962 Ponceleugene ..... B63C 9/24 222/5
3,091,782 A * 6/1963 Sclafani ..... B64C 25/56 244/101
3,182,630 A * 5/1965 David ..... B01D 35/143 116/268
3,221,932 A * 12/1965 Anderson ..... B63C 9/24 222/5
3,426,942 A * 2/1969 Friedman ..... F42C 3/00 222/5

(Continued)

*Primary Examiner* — Charles P. Cheyney
*Assistant Examiner* — Michael J. Melaragno
(74) *Attorney, Agent, or Firm* — GrayRobinson, P.A.

(57) ABSTRACT

An inflator including in combination an inflator body having at one end an input for receiving the neck of a gas cartridge, a manifold assembly intended to be fluidly connected to an inflatable, a combination automatic and manual actuator assembly including a spring-loaded actuator including a pierce pin for fracturing a frangible seal of the gas cartridge, a bobbin with a dissolvable pill that retains the spring-loaded actuator in a cocked position and a hood connected onto the end of the inflator body, said hood including an inwardly-extending tab that engages the actuator to securely retain the hood onto the end of the inflator body by means of the inwardly-extending tab being grasped by the forked end of the actuator.

16 Claims, 42 Drawing Sheets

(56) References Cited

U.S. PATENT DOCUMENTS 3,526,339 A * 9/1970 Jost ..... B63C 9/24 222/5
3,579,964 A * 5/1971 Ohlstein ..... B63C 9/24 222/5
3,610,470 A * 10/1971 Waters ..... B63C 9/24 222/5
3,702,014 A * 11/1972 Rabon ..... B63B 22/003 441/6
3,757,371 A * 9/1973 Martin ..... B64D 17/78 441/94
3,809,288 A * 5/1974 Mackal ..... B63C 9/24 222/5
3,910,457 A * 10/1975 Sutliff ..... B64D 17/38 222/5
3,997,079 A * 12/1976 Niemann ..... B63C 9/24 222/5
4,223,805 A * 9/1980 Mackal ..... B63C 9/18 222/5
4,260,075 A * 4/1981 Mackal ..... B63C 9/18 222/5
4,267,944 A * 5/1981 Mackal ..... B63C 9/18 222/5
4,382,231 A * 5/1983 Miller ..... G01N 27/06 244/151 B
4,436,159 A * 3/1984 Revay ..... A62C 35/08 137/68.13
4,475,664 A * 10/1984 Mackal ..... B63C 9/24 222/5
4,488,546 A * 12/1984 Bernhardt ..... A62B 18/084 128/201.23
4,498,604 A * 2/1985 Mackal ..... B63C 9/24 141/329
4,498,605 A * 2/1985 Mackal ..... B63C 9/24 222/5
4,500,014 A * 2/1985 Zimmerly ..... B63C 9/24 222/5
4,513,248 A * 4/1985 Miller ..... B64D 17/38 244/151 B
4,627,823 A * 12/1986 Mackal ..... B63C 9/24 441/95
5,026,310 A * 6/1991 Mackal ..... B63C 9/24 441/92
5,076,468 A * 12/1991 Mackal ..... B63C 9/24 222/5
5,333,656 A * 8/1994 Mackal ..... B63C 9/24 141/19
5,333,756 A * 8/1994 Glasa ..... B63C 9/24 222/5
5,370,567 A * 12/1994 Glasa ..... B63C 9/24 222/5
5,413,247 A * 5/1995 Glasa ..... B63C 9/18 222/23
5,562,233 A * 10/1996 Glasa ..... B63C 9/24 222/23
5,564,478 A * 10/1996 Weinheimer ..... B63C 9/24 141/19
5,601,124 A * 2/1997 Weinheimer ..... B63C 9/24 141/19
5,643,030 A * 7/1997 Brown ..... B63C 9/24 116/277
5,685,455 A * 11/1997 Glasa ..... B63C 9/24 222/5
5,694,986 A * 12/1997 Weinheimer ..... B63C 9/24 141/19
5,852,986 A * 12/1998 Mackal ..... B63C 9/24 116/266
6,422,420 B1 * 7/2002 Brown ..... B63C 9/24 116/277
6,435,371 B1 * 8/2002 Perrins ..... B63C 9/24 222/5
6,589,087 B2 * 7/2003 Mackal ..... B63C 9/18 222/5
6,705,488 B2 * 3/2004 Mackal ..... B63C 9/24 222/5
7,475,711 B2 * 1/2009 Fawcett, Jr. ..... B63C 9/24 141/329
7,572,161 B2 * 8/2009 Mackal ..... B63C 9/24 222/5
7,854,347 B2 * 12/2010 Wang ..... B63C 9/24 222/5
7,861,373 B2 * 1/2011 Fawcett, Jr. ..... F16G 11/101 16/110.1
8,141,208 B2 * 3/2012 Fawcett, Jr. ..... F16G 11/101 16/422
8,353,736 B2 * 1/2013 Wang ..... F04B 33/005 441/93
8,360,276 B2 * 1/2013 Rogier ..... B63C 9/19 222/5
9,045,207 B2 * 6/2015 Anderson ..... B63C 9/19
9,365,270 B2 * 6/2016 Lee ..... B63C 9/155
9,499,244 B2 * 11/2016 Best ..... B63C 9/18
9,732,867 B2 * 8/2017 Fawcett ..... F16K 17/0433
10,017,231 B2 * 7/2018 Fawcett, Jr. ..... B63C 9/18
10,730,595 B2 * 8/2020 Fawcett ..... B63C 9/24
2003/0049981 A1 * 3/2003 Mackal ..... B63C 9/18 441/92
2003/0049982 A1 * 3/2003 Mackal ..... B63C 9/24 441/97
2004/0002270 A1 * 1/2004 Courtney ..... B63C 9/0005 441/40
2004/0124209 A1 * 7/2004 MacKal ..... B63C 9/24 222/54
2005/0086766 A1 * 4/2005 Fawcett, Jr. ..... F16G 11/101 16/110.1
2007/0193625 A1 * 8/2007 Mackal ..... B63C 9/24 137/68.3
2008/0000926 A1 * 1/2008 Wang ..... B63C 9/24 222/5
2009/0090741 A1 * 4/2009 Oberhofer ..... B67D 1/0418 222/5
2009/0255087 A1 * 10/2009 Fawcett, Jr. ..... F16G 11/103 16/110.1
2009/0255088 A1 * 10/2009 Fawcett, Jr. ..... F16G 11/101 16/110.1
2011/0000550 A1 * 1/2011 Rogier ..... B63C 9/19 137/1
2012/0073466 A1 * 3/2012 Wang ..... F04B 33/005 102/530
2012/0217263 A1 * 8/2012 Becnel ..... B63C 9/19 222/5
2013/0313282 A1 * 11/2013 Best ..... B63C 9/19 222/5
2016/0280342 A1 * 9/2016 Fawcett, Jr. ..... B63C 9/18
2017/0108315 A1 * 4/2017 Mackal ..... F42B 3/04
2017/0190400 A1 * 7/2017 Best ..... B63C 9/19
2019/0308701 A1 * 10/2019 Hernandez ..... B63C 9/19
2019/0382088 A1 * 12/2019 Fawcett ..... B63C 9/19
2020/0001954 A1 * 1/2020 Best ..... B63C 9/18
2020/0055580 A1 * 2/2020 Fawcett ..... F16K 51/00

* cited by examiner

DISPOSABLE INFLATOR

CROSS-REFERENCE TO RELATED INVENTIONS

This application is a continuation-in-part of patent application Ser. No. 16/440,759, filed Jun. 13, 2019, issuing as U.S. Pat. No. 10,730,595 on Aug. 4, 2020, which claims the benefit of provisional application No. 62/693,022, filed Jul. 2, 2018 and 62/684,725, filed Jun. 13, 2018, the disclosures of which are incorporated by reference herein.

BACKGROUND OF THE INVENTION

Field of the Invention

This invention relates to automatic inflators for inflatable articles such as life rafts, life vests, and the like. More particularly, this invention relates to inflators that are actuated automatically upon immersion in water or manually.

Description of the Background Art

Presently, there exists many types of inflators designed to inflate inflatable articles such as personal floatation devices (life vests, rings and horseshoes), life rafts, buoys and emergency signaling equipment. Manual inflators typically comprise a body for receiving the neck of a cartridge of compressed gas such as carbon dioxide. A reciprocating pierce pin is disposed within the body of the inflator for piercing the frangible seal of the cartridge to permit compressed gas therein to flow into a manifold assembly of the inflator and then into the article to be inflated. Typically, a manually movable firing lever is operatively connected to the pierce pin through the use of a pierce pin actuator such that the pierce pin pierces the frangible seal of the gas cartridge upon jerking of a ball lanyard tethered to the actuator. U.S. Pat. No. 3,809,288, the disclosure of which is hereby incorporated by reference herein, illustrates one particular embodiment of a manual inflator.

While manual inflators work suitably well, it was quickly learned that in an emergency situation, the person needing the assistance of the inflatable device, such as a downed aviator, injured person, or a man overboard, would fail or be unable to manually activate the inflator. Accordingly, it was realized that a means should be provided for automatically activating the inflator in such an emergency situation.

In response to this realized inadequacy of the prior art manual inflators, water-activated automatic inflators were developed which automatically actuate the pierce pin of the inflator when immersed in water thereby causing inflation of the inflatable device. Typical water-activated automatic inflators comprise a water activated actuator including a water destructible or dissolvable element often referred to as a "pill" positioned within a bobbin, which retains a spring-loaded actuator pin in a cocked position in alignment with the pierce pin. Upon exposure to water, the dissolvable pill contained within the bobbin immediately starts dissolving and then destructs altogether, whereupon it loses its ability to hold-back the spring-loaded actuator pin in its cocked position. The spring-loaded actuator pin is thus released to forcibly move from its cocked position to an actuated position to strike the pierce pin, either directly or indirectly by means of an intermediate transfer pin. Upon striking the pierce pin, the pin fractures the seal of the cartridge thereby allowing the gas contained therein to flow into the inflatable device to inflate the same.

Representative automatic actuators for inflators are disclosed in U.S. Pat. Nos. 3,059,814, 3,091,782, 3,426,942, 3,579,964, 3,702,014, 3,757,371, 3,910,457, 3,997,079, 4,223,805, 4,267,944, 4,260,075, 4,382,231, 4,436,159, 4,513,248, 4,627,823, 5,076,468, 5,601,124, 5,685,455, 5,562,233, 5,370,567, 5,333,756, 4,488,546 and 5,694,986, the disclosures of which are hereby incorporated by reference herein.

A disadvantage to automatic inflators employing a dissolvable pill is the tendency to prematurely destruct in non-emergency situations by exposure of the pill to excessive humidity in the air. Bobbin pills of various designs and chemical compositions have been used to minimize their susceptibility to humidity. Further, in most automatic inflators, the bobbin with its pill is replaceable so that the inflator may be rearmed periodically pursuant to a preplanned maintenance schedule to minimize the risk of premature actuation due to prolonged exposure to humidity. Along with the installation of a new, unspent gas cartridge, the replaceable feature of the bobbin also allows the automatic inflator to be rearmed with a new bobbin after firing upon submersion in water. In both scenarios, replacing the bobbin and if need be the spent gas cartridge allows the inflator to be repeatedly rearmed by the end user as needed over the course of many years. Indeed, rearm kits for most automatic inflators are readily available for sale to users at retail stores and online so that the users can rearm their automatic inflators whenever needed.

While replacement of bobbins in automatic inflators, and if need be the gas cartridge, allows the inflator to be in use for many years, it is sometimes desirable to design a "disposable" automatic inflator to be manufactured so economically with fewer components that it can simply be discarded after being fired or pursuant to the preplanned maintenance schedule instead of being rearmed with a rearm kit.

Prior art tethers for inflators (e.g., U.S. Pat. No. 3,809,288) typically comprise a tether assembly including a cord that was molded at one end in situ with the jerk handle. The trailing end of the cord would then be operatively connected to the pierce pin actuator via crimped loop. The tether assemblies are typically manufactured in specific lengths for each intended application.

Prior art manifold assemblies (e.g., U.S. Pat. No. 3,809,288) typically comprise a mounting flange heat-sealed to the inflatable article, with the inflator then sealingly connected thereto by a mounting bolt, which precludes easy replacement of the inflator for replacing the bobbin or for routine maintenance of the inflator.

Therefore, it is an object of this invention to provide an improvement which overcomes the aforementioned inadequacies of the prior art inflators and provides an improvement which is a significant contribution to the advancement of the disposable inflation art.

Another object of this invention is to provide an automatic inflator that is designed to be manufactured so economically for sale to users that it may be simply discarded and a new one installed.

Another object of this invention is to provide a user with an indicator that shows whether the disposable inflator has been fired.

Another object of this invention is to provide a disposable automatic inflator having a design that precludes or substantially impairs any attempted rearming of a spent inflator by the user and therefore requires the user to discard the spent inflator and purchase a new one.

Another object of this invention is to provide a disposable automatic inflator having a manifold assembly that allows a spent inflator to be easily removed by the user from the inflatable and once removed, not reinstalled, thereby assuring that the user replaces the spent inflator with a new one.

Another object of this invention is to provide a tether assembly for an inflator wherein an elongated member and a jerk handle are molded together in situ with the trailing end of the elongated member including barbed protuberances extending along its length (e.g., three) that, during assembly to the pierce pin actuator, could be progressively threaded through a hole in the actuator to the desired tether length with the exposed trailing end being trimmed off, thereby obviating the need to maintain an inventory of inflators with differently-length tethers.

Another object of this invention is to provide an assembly manifold for an inflator that facilitates easy replacement of the inflator or for routine maintenance of the inflator.

These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purposes of summarizing the invention, the invention comprises a disposable inflator composed of a minimal number of components that can be so economically manufactured to render it "disposable" after firing or pursuant to a maintenance schedule. Further, the design of the disposable inflator of the invention is such that rearming a spent inflator is rendered nearly impossible by a user to thereby minimize any attempt by the user to try to rearm it instead of disposing of it and installing a new one on the inflatable.

The invention further comprises a tether assembly for an inflator comprising an elongated member and a jerk handle mold together in situ with the trailing end of the elongated member including barbed protuberances extending along its length (e.g., three). During assembly to the actuator of the inflator, the barbed protrusions are progressively threaded through a hole in the actuator to the desired tether length. The exposed trailing end is then being trimmed off. The inventory of tether assemblies with different lengths of tethers is therefore minimized.

The invention further comprises a manifold assembly for an inflator that facilitates easy replacement of the inflator (or for routine maintenance) of the inflator is such a manner that the user may remove spent inflator and install a new one. In one embodiment of the manifold assembly, the spent inflator may be easily removed but not reinstalled, thereby assuring that the user actually installs a new inflator in its stead and does not simply reinstall the spent inflator.

The foregoing has outlined rather broadly, the more pertinent and prominent features of the present invention. The detailed description of the invention that follows is offered so that the present contribution to the art may be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other methods and structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a more succinct understanding of the nature and objects of the invention, reference should be directed to the following description taken in conjunction with the accompanying drawings in which:

FIG. 45 is an elevational view showing the removal key pivoted to disengage the manifold from the manifold assembly whereas

Similar reference numerals refer to similar parts throughout the several figures.

DETAILED DESCRIPTION OF THE PREFERRED EMBODIMENTS

Figure 1:
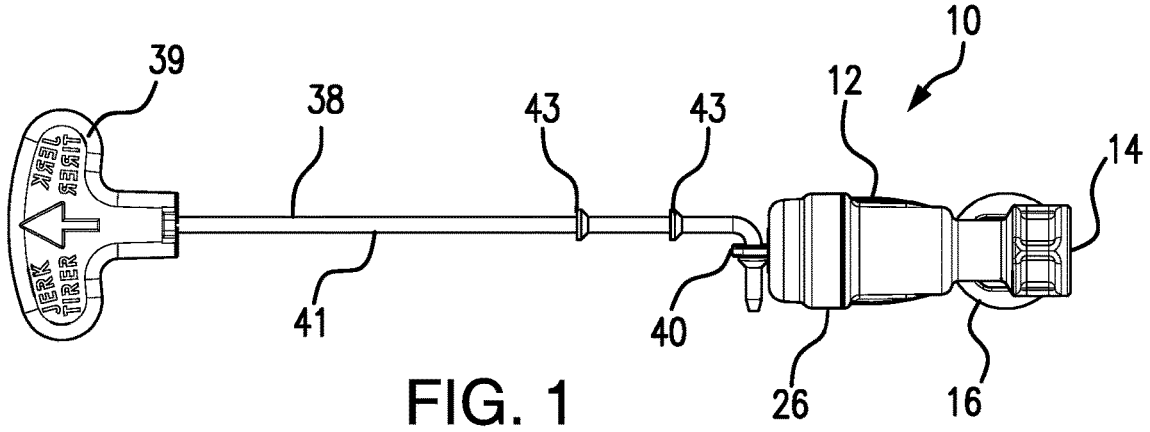
FIGS. 1-4 are front, right side, bottom and left side views of a first embodiment of the inflator of the invention.
Figure 2:
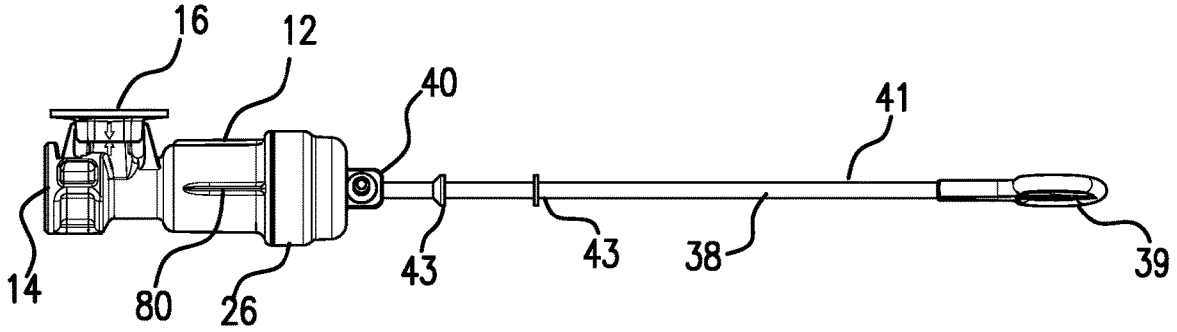
Figure 3:
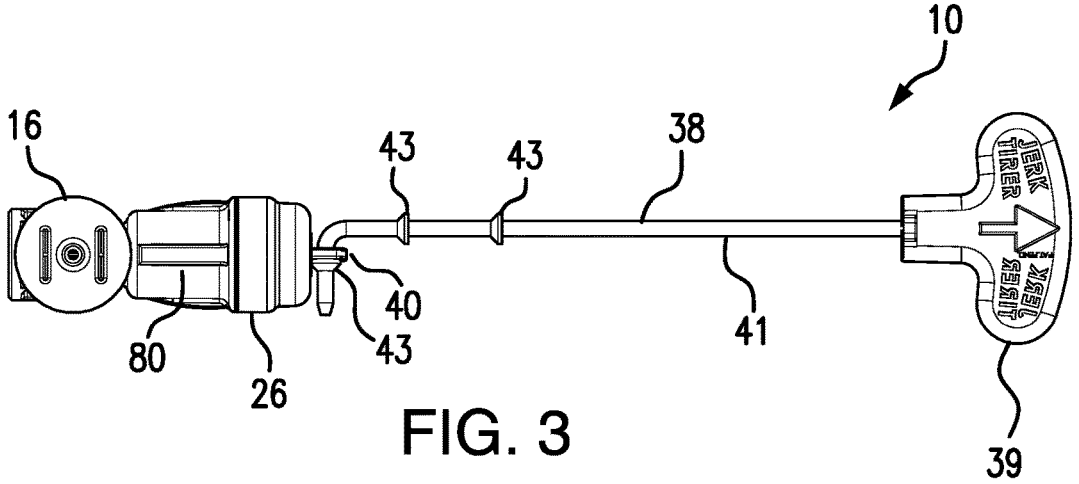
Figure 4:
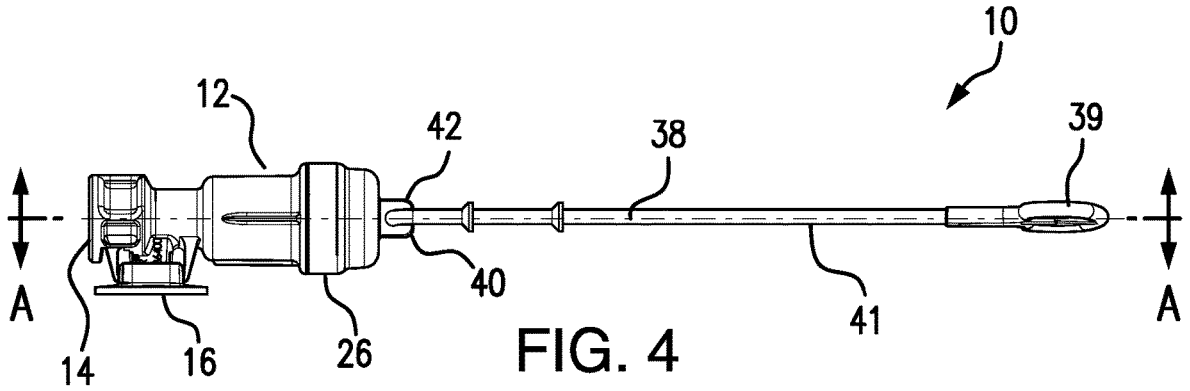
Figure 5A:
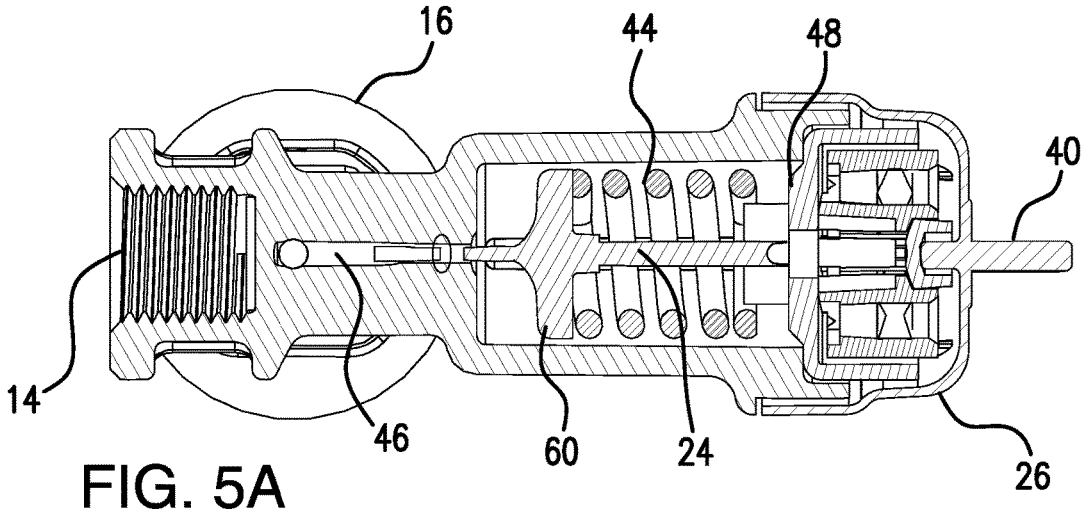
FIGS. 5A&B and 6A are cross-sectional views of the inflator of the invention.

Referring to FIGS. 1-8, the disposable inflator 10 of the invention comprises an inflator body 12 having at one end a threaded input 14 for receiving the threaded neck of a conventional gas cartridge (not shown) which is in fluid communication with a manifold assembly 16 intended to be sonic welded to an inflatable (not shown). The other end of the inflator body 12 includes a combination automatic and manual actuator assembly 18 comprising a bobbin 20 with a dissolvable pill 22 that retains a spring-loaded actuator 24 in a cocked position by an annular ring seat 32 that engages the bobbin 20. A hood 26 is snap-fitted onto the end of the body 12. The hood 26 includes at least one inwardly-extending axial tab 28 that engages into and is squeezed by the by at least one pair of tines 30T of the forked end 30 of the actuator 24 to keep the forked end 30 in engagement within an annular ring seat 32 (see FIG. 6) and to securely retain the hood 26 onto the end of the body 12 by means of its inwardly-extending axial tab(s) 28 being grasped by the tines 30T of the forked end 30 of the actuator 24 (e.g., requiring about 10 pounds to as much as 15 pounds of pulling force to remove the hood 26).

Figure 47B:
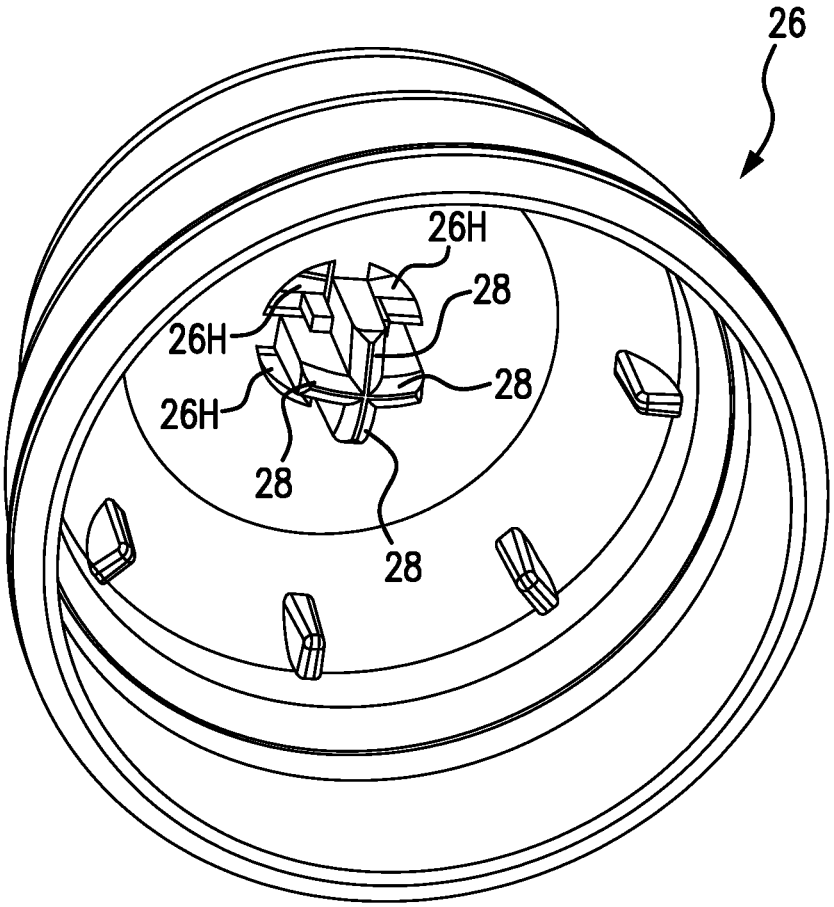
FIG. 47B is a perspective view of the underside of the second embodiment of the hood better showing its vent holes and axial tabs.

There exist two embodiments of the spring-loaded actuator 24 and hood 26, the differences being that the first embodiment of the spring-loaded actuator 24 comprises a forked end 30 having two tines 30T and the first embodiment of the hood 26 comprises one tab 28 to be grasped between the two tines 30T whereas the second embodiment of the of the spring-loaded actuator 24 comprises a forked end 30 having four tines 30T and the second embodiment of the hood 26 comprises two tabs 28 aligned in an "X" quadrant (see FIG. 47) to be respectively grasped by the four tines 30T. The first embodiment employs the annular ring seat 32 whereas the second embodiment eliminates the need for the annular ring seat 32. For clarity, where visible in the drawings and discussed the first embodiment is shown in drawings suffixed with an "A" (i.e., FIGS. 5A, 6A, 7A, 8A, 13A, 14A, 15A, 23A, 24A, 27A, 28A and 31A), whereas where visible in the drawings and discussed the second embodiment is suffixed with a "B" (i.e., FIGS. 5B, 6B, 7B, 8B, 14B, 15B and 47B).

It is noted that the hood 26 protects the pill 22 in the bobbin 20 from splashes of water that might otherwise inadvertently cause unintended firing of the inflator 10. Hood 26 may include vent holes 26H to allow venting of the area underneath the hood 26 proximate to the bobbin 20 to assure that the bobbin 20 is rapidly flooded upon immersion. Hood 26 is preferably colored green to indicate an operable condition of the inflator 10. Hood 26 conceals the end of the inflator body 12 and bobbin 20 which may each or both be colored red that is exposed to view when the hood 26 is removed, thereby indicating a "spent" or inoperable condition.

It is noted that the hood 26 may not be simply reinstalled due to the fact that the forked end 30 moving inward toward the gas cartridge once the hood 26 is removed (explained in greater detail below) and is therefore not capable of re-grasping the inwardly-extending axial tab(s) 28 of the hood 26. Indeed, if the user tries to reinstall the hood 26, it would simply fall off.

A tether assembly 38 is connected to an axial tab 40 via its hole 42 extending outwardly from the hood 26. According to this invention, the tether assembly 38 comprises simultaneously molding a jerk handle 39 with a flexible elongated member 41 having a plurality of barbed protrusions 43 extending along its length (e.g., three are shown). The barbed protrusions 43 are angled toward its trailing end and the flat portion faces the jerk handle 39. The angle portion allows the trailing end of the elongated member 41 to be inserted into the hole 42 and the barbed protrusion(s) 43 pulled through the hole 42 until the desired length is attained. The flat portion of the barbed protrusions 43 preclude the barbed protrusions 43 from being pulled back through the hole 42. When the desired length is attained, the exposed trailing end may be trimmed off. This feature obviates the need to maintain an inventory of inflators with differently-length tethers.

For manual operation, jerking on the tether 38 snaps the hood 26 off of the body 12 by pulling the inwardly-extending axial tab(s) 28 of the hood 26 out from being grasped by the tines 30T of the forked end 30 of the actuator 24, allowing the actuator 24 having a pierce pin 46 to be forcibly moved by a heavy spring 44 toward the gas cartridge to pierce the frangible seal of the gas cartridge.

For automatic operation, when the pill 22 dissolves upon submersion in water, the arms 36 of the bobbin 20 are allowed to pivot inwardly to expand the collective diameter of the radial seats 34, thereby, in the case of the first embodiment releasing the ring seat 32, and in the first and second embodiments allowing the actuator 24 to be forcibly moved by the heavy spring 44 toward the gas cartridge such that the pierce pin 46 pierces the frangible seal of the gas cartridge.

More particularly, as shown in FIGS. 7-13, the bobbin 20 is positioned within a bobbin housing 48. The bobbin 20 and the inner lumen of the bobbin housing 48 may optionally include conventional unsymmetrical complementary keyways 50B and 50H to ensure that the bobbin 20 is inserted correctly right-side up into the housing 48. In this regard it is noted that the bobbin 20 may be assembled automatically by an assembly machine in which case the keyways 50 are not necessary.

The housing 48 is rigidly affixed rotationally and axially within a longitudinal bore of the body 12 by a pair of spaced-apart dowels 52 that fit through corresponding slots 54 in a boss 56 extending from the end of the housing 48 and into corresponding holes 58 in the longitudinal wall of the body 12. The high-pressure spring 44 is compressed and positioned between the dowels 53 and an annular ledge 60 formed on the actuator 24, thereby constantly urging the actuator 24 toward the gas cartridge.

As best shown in FIGS. 14 and 15, the actuator 24 comprises an elongated shaft 62 with its annular ledge 60 formed integrally therewith. The spring-side of the ledge 60 comprises a plurality of equally-spaced radial protuberances 64 (e.g., four) to center the spring 44 onto the ledge 60. The end of the actuator 24 includes a pierce pin 46 with stakes 46S press-fitted therein which is alignment with the frangible seal of the gas cartridge. An O-ring groove 66 for receiving a conventional O-ring 68 is formed on the portion of the actuator that extends into a reduced diameter portion 70 of the longitudinal bore of the body 12 to assure that, upon firing, all the compressed gas from the cartridge exits through the exhaust port 72 of the body 12, through the manifold assembly 16 and into the inflatable. The actuator 24 further includes opposing alignment ears 74 extending radially from opposing sides of the actuator 24. The alignment ears 74 fit into corresponding slots 76 formed in the boss 56 of the bobbin housing 48 to preclude rotational movement of the actuator 24. Similarly, the outer rim of the ledge 60 includes an integrally-formed protrusion 78 that rides in slot 80 formed in the inner lumen of the longitudinal bore of the body 12.

Figure 6A:
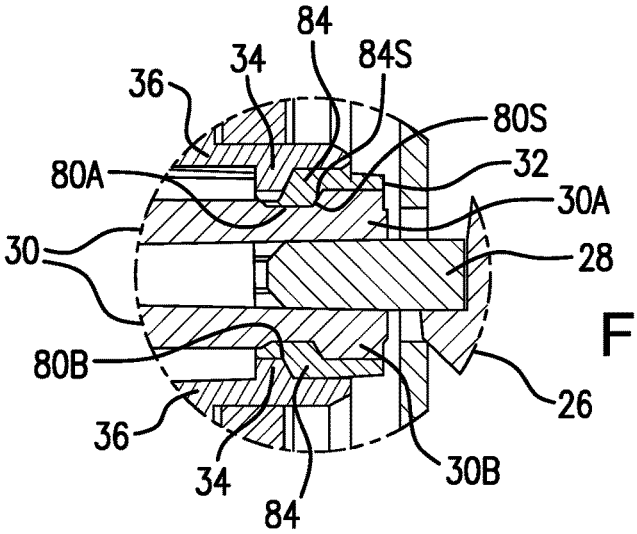
Figure 5B:
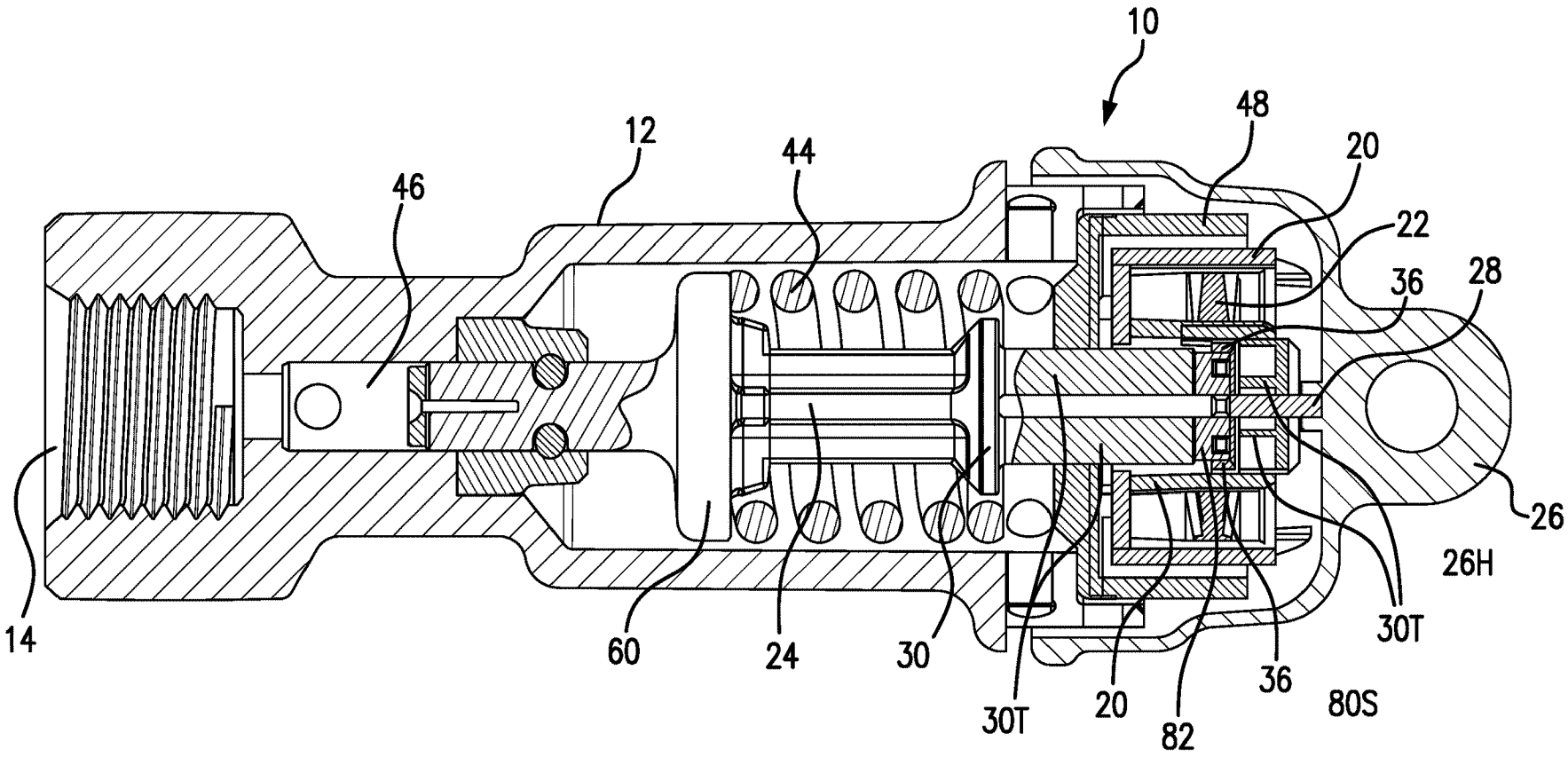
Figure 7A:
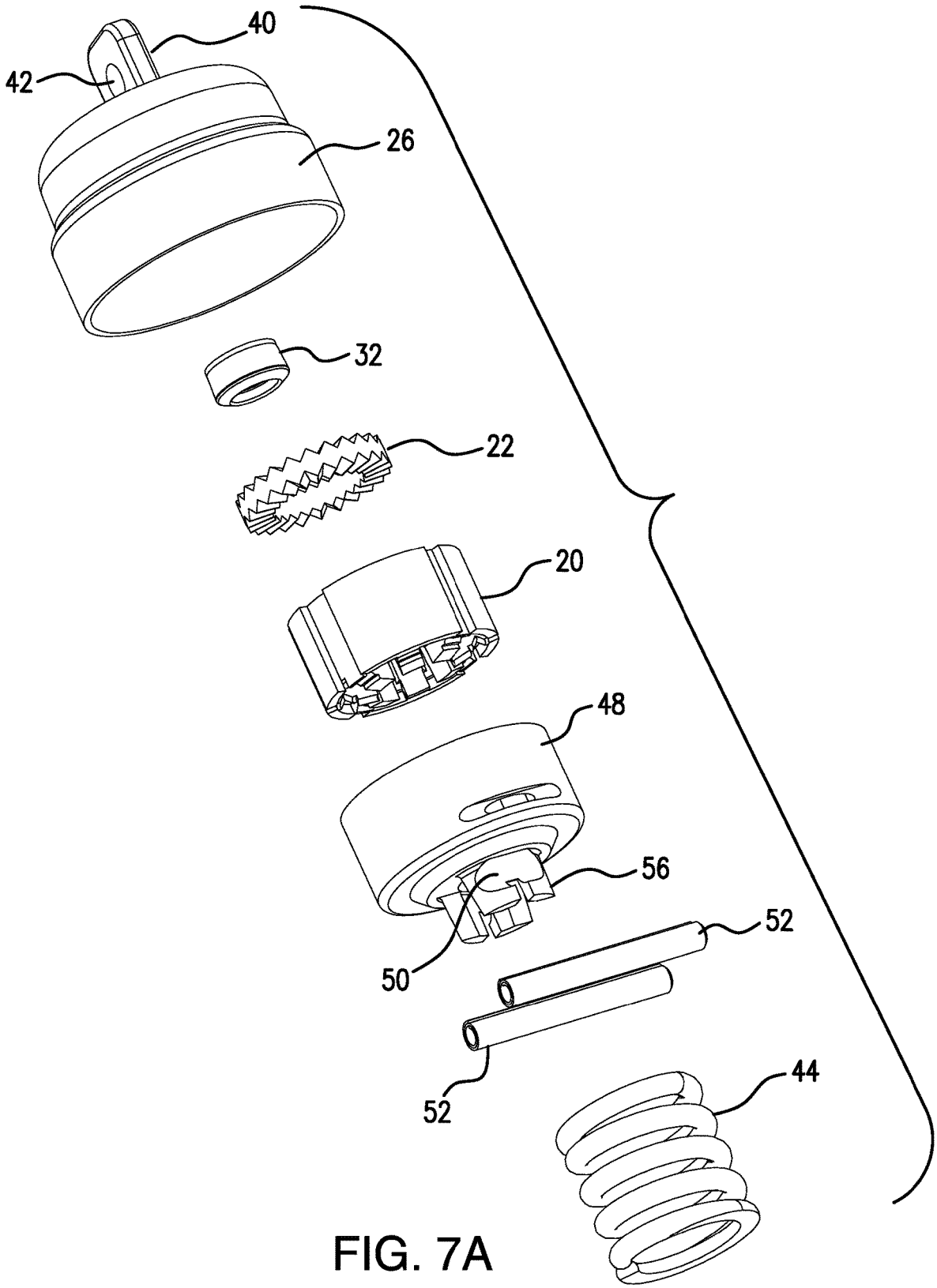
FIGS. 7A&B and 8A&B are exploded views of the inflator of the invention.
Figure 7B:
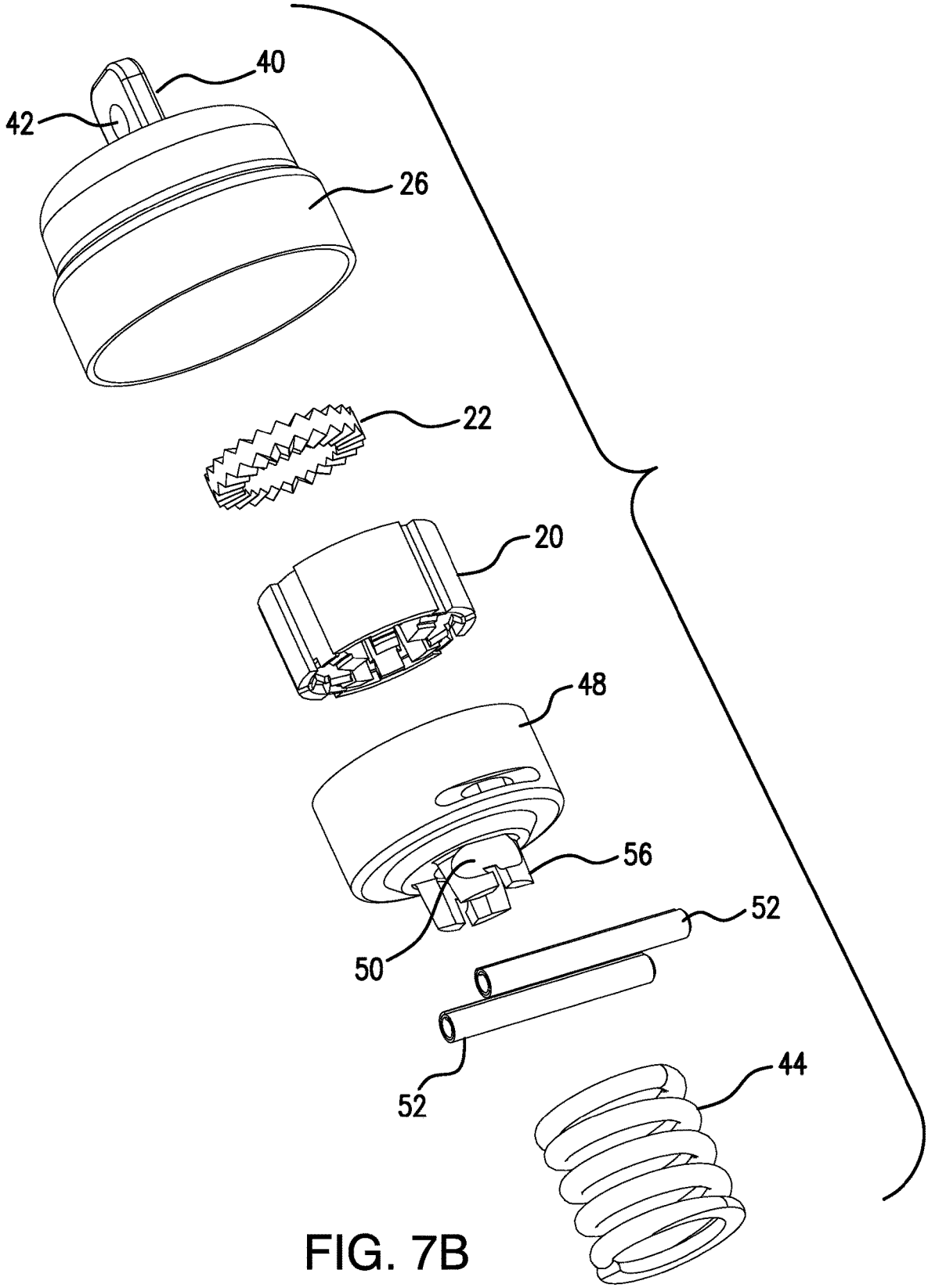
Figure 8A:
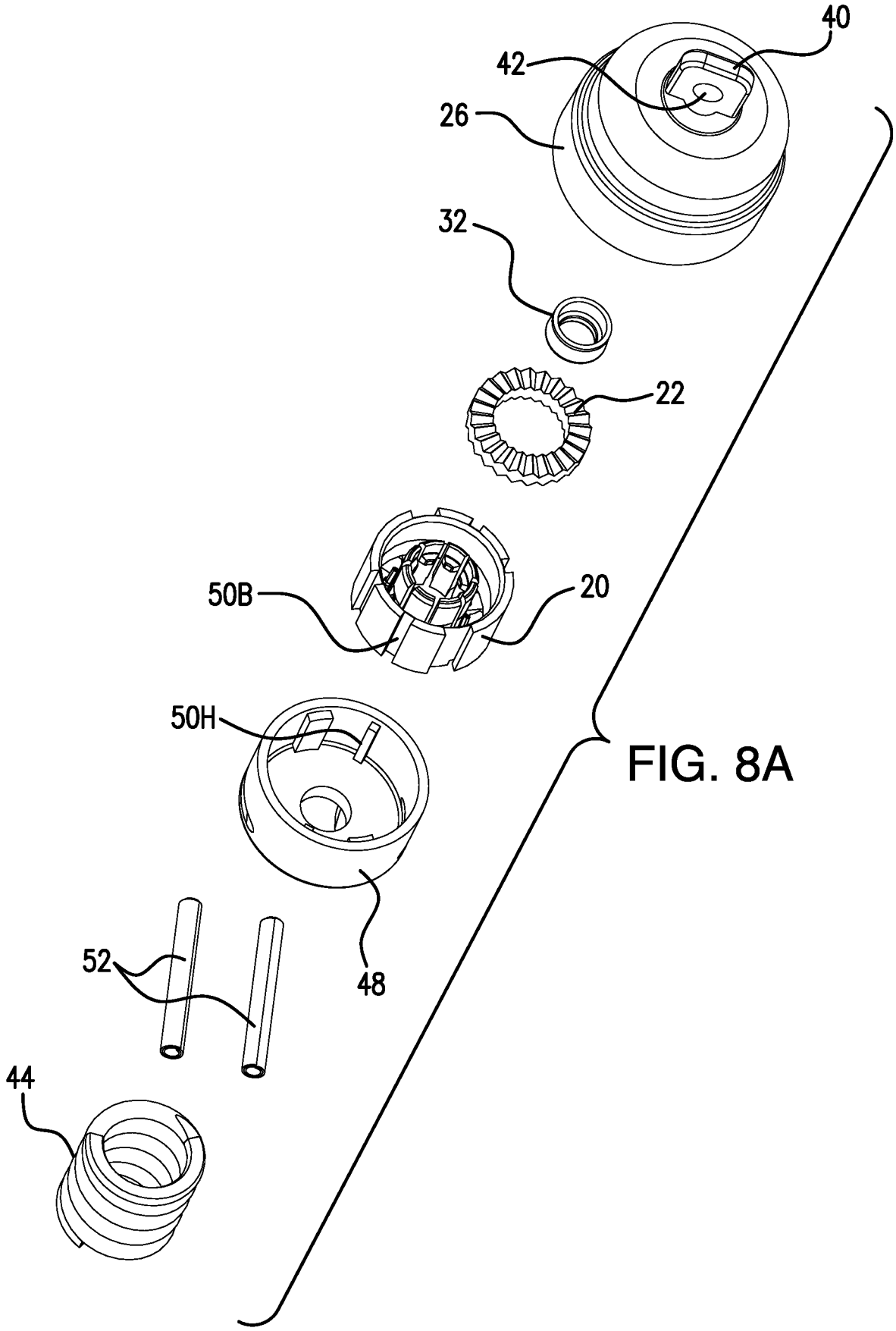
Figure 8B:
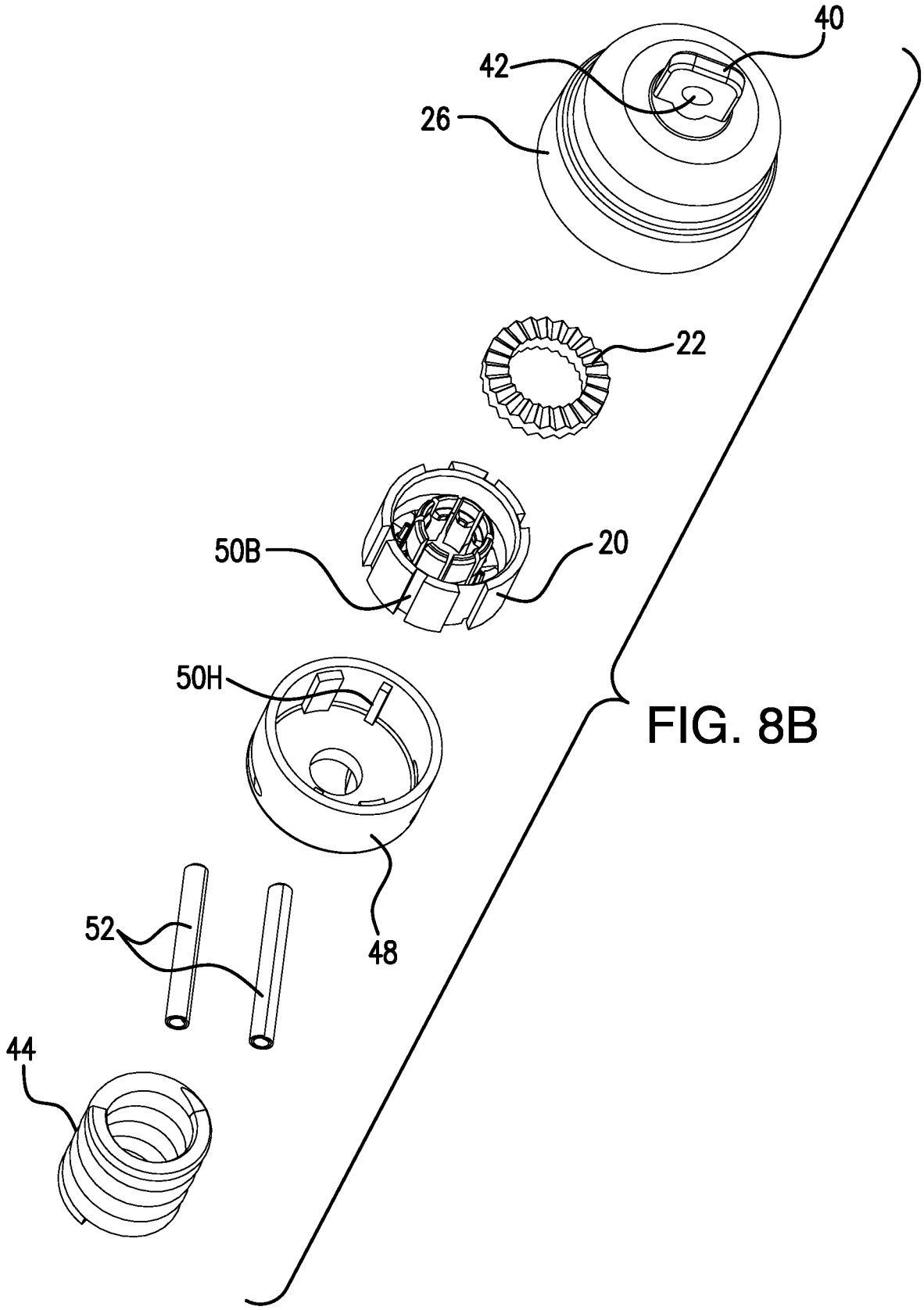
Figure 9:
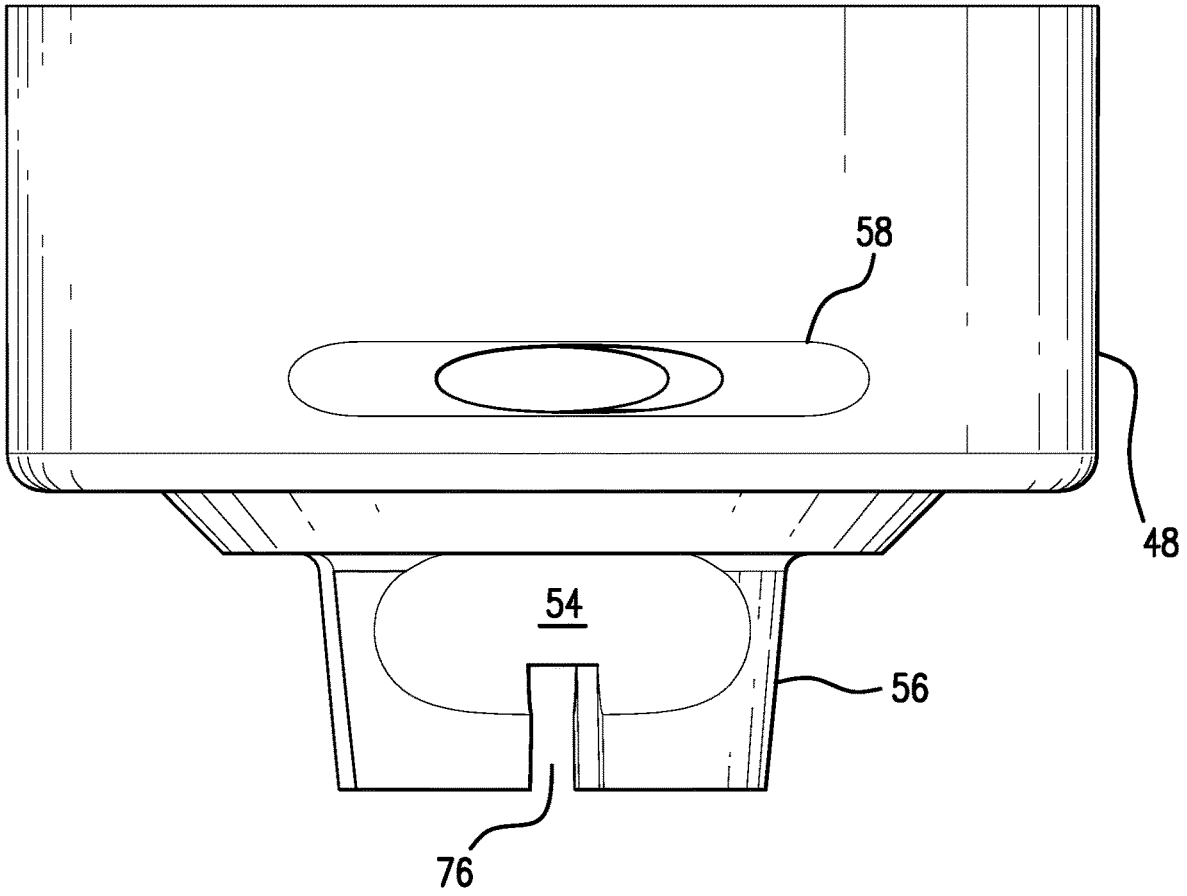
FIGS. 9 and 10 illustrate the bobbin housing of the inflator of the invention.
Figure 10:
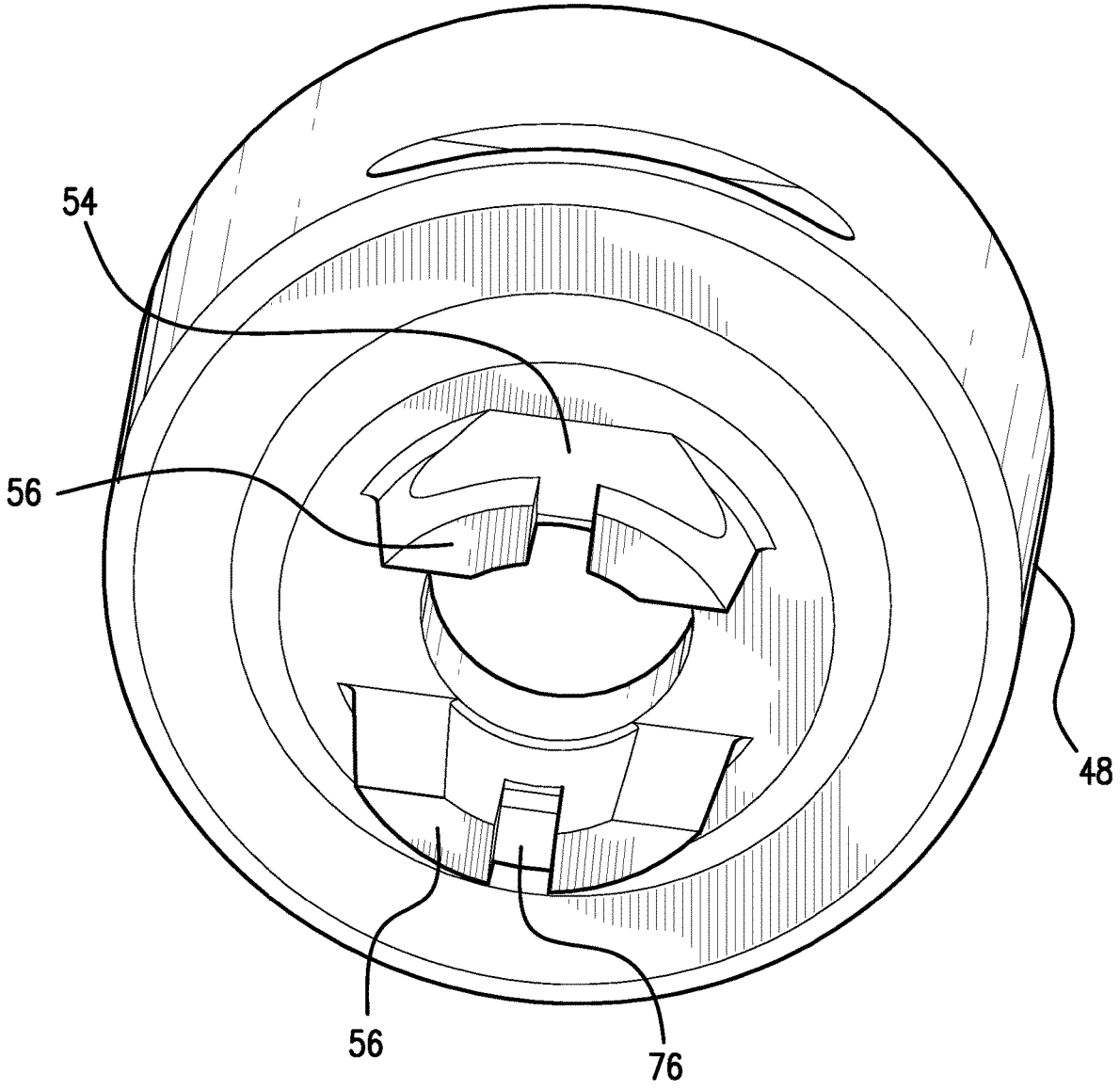
Figure 11:
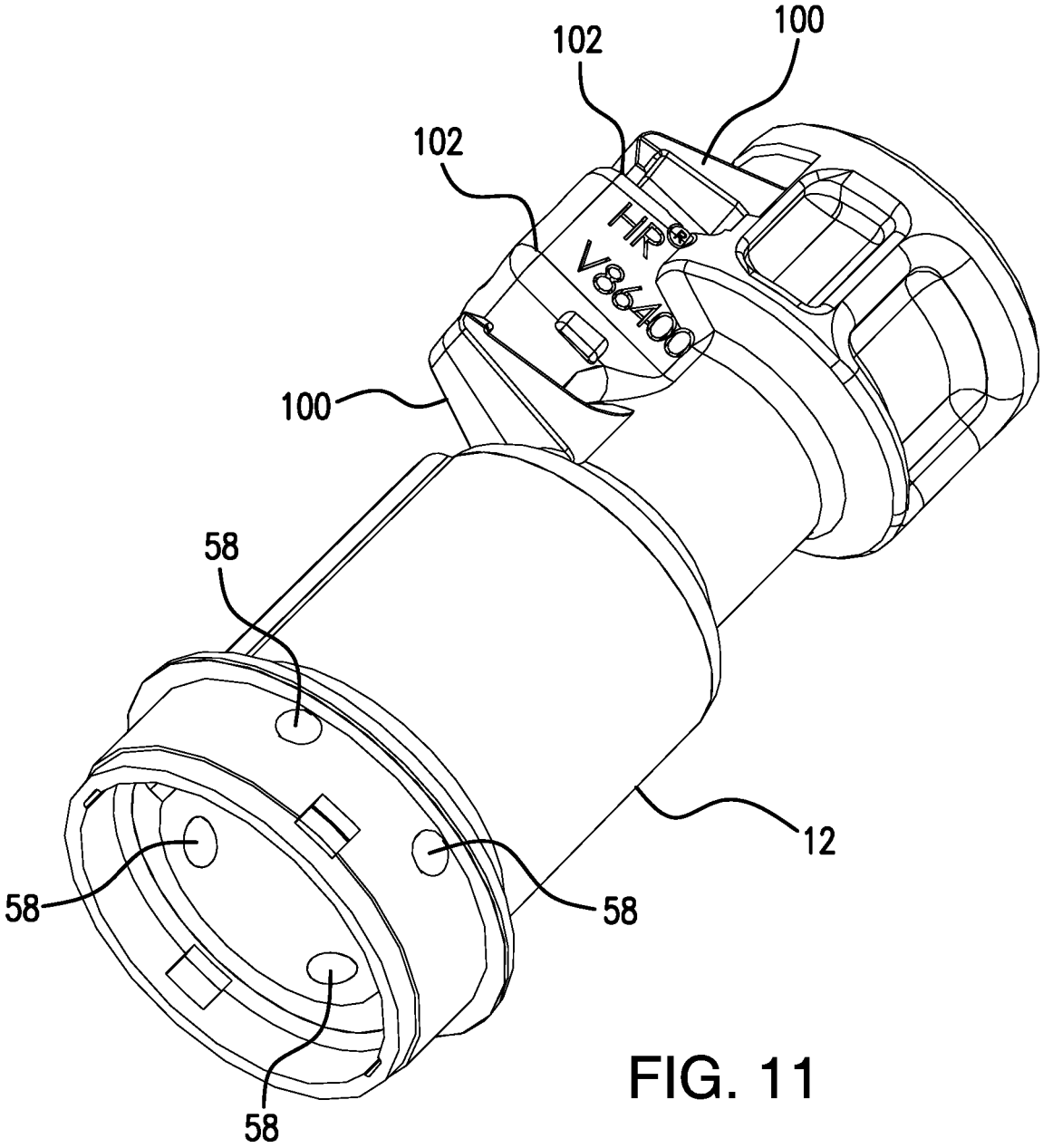
FIGS. 11 and 12 illustrate the body of the inflator of the invention.
Figure 12:
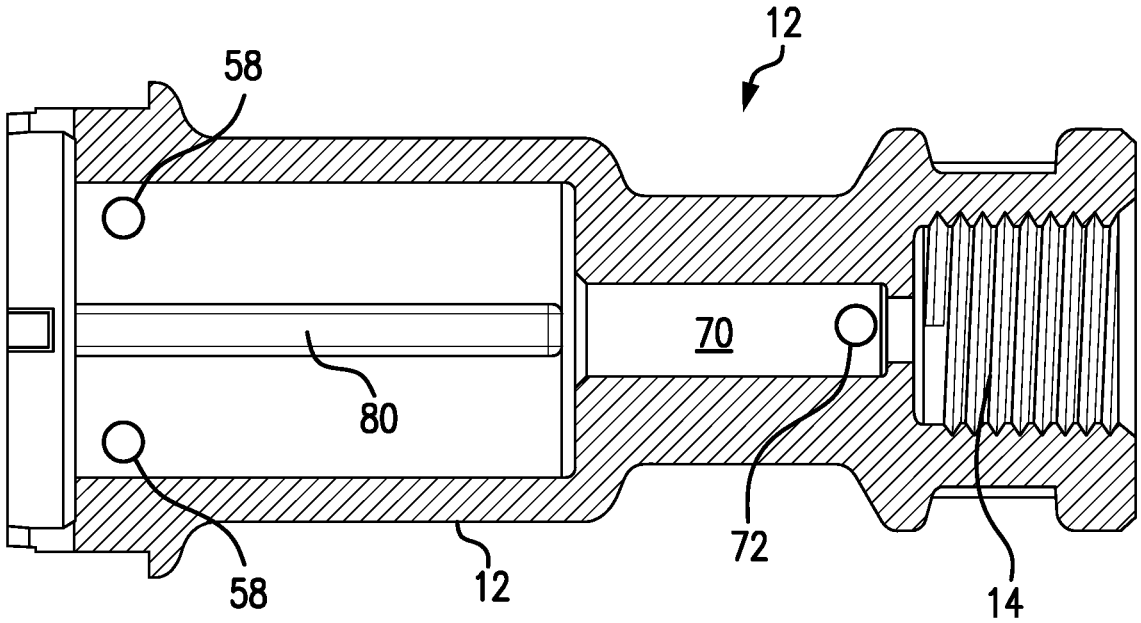
Figure 13A:
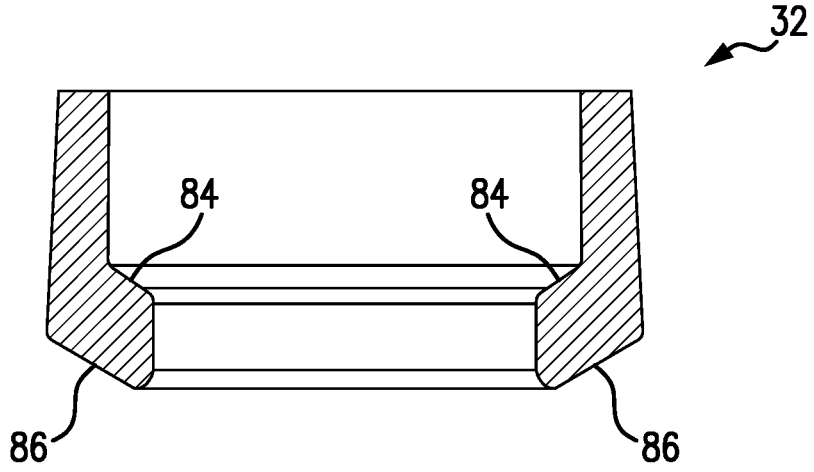
FIG. 13A is a partially cut-away cross-sectional view of the ring seat of the inflator of the invention.
Figure 14A:
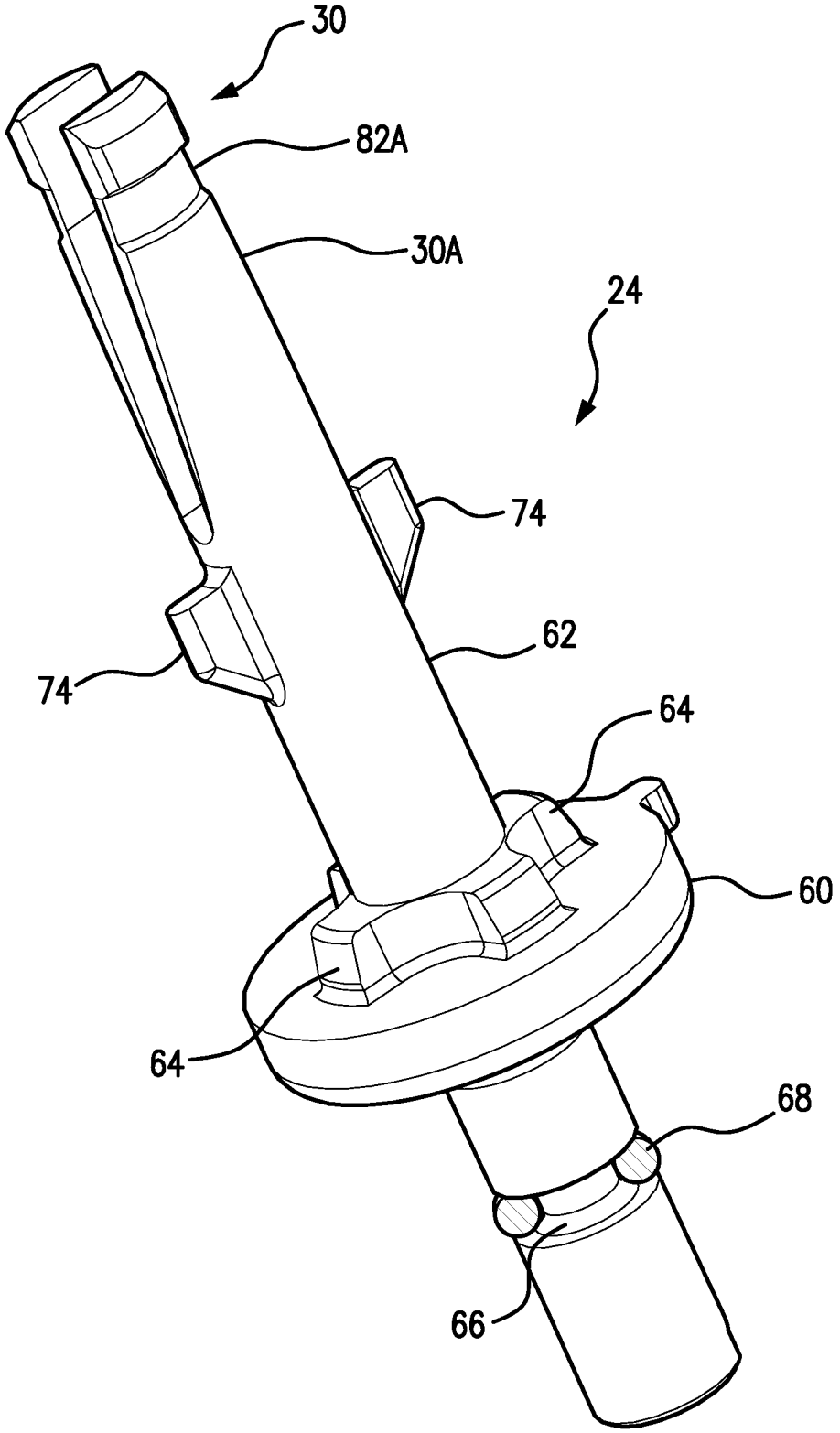
FIGS. 14A&B and 15A&B illustrate the actuator and FIG. 16 illustrates the pierce pin of the inflator of the invention.
Figure 14B:
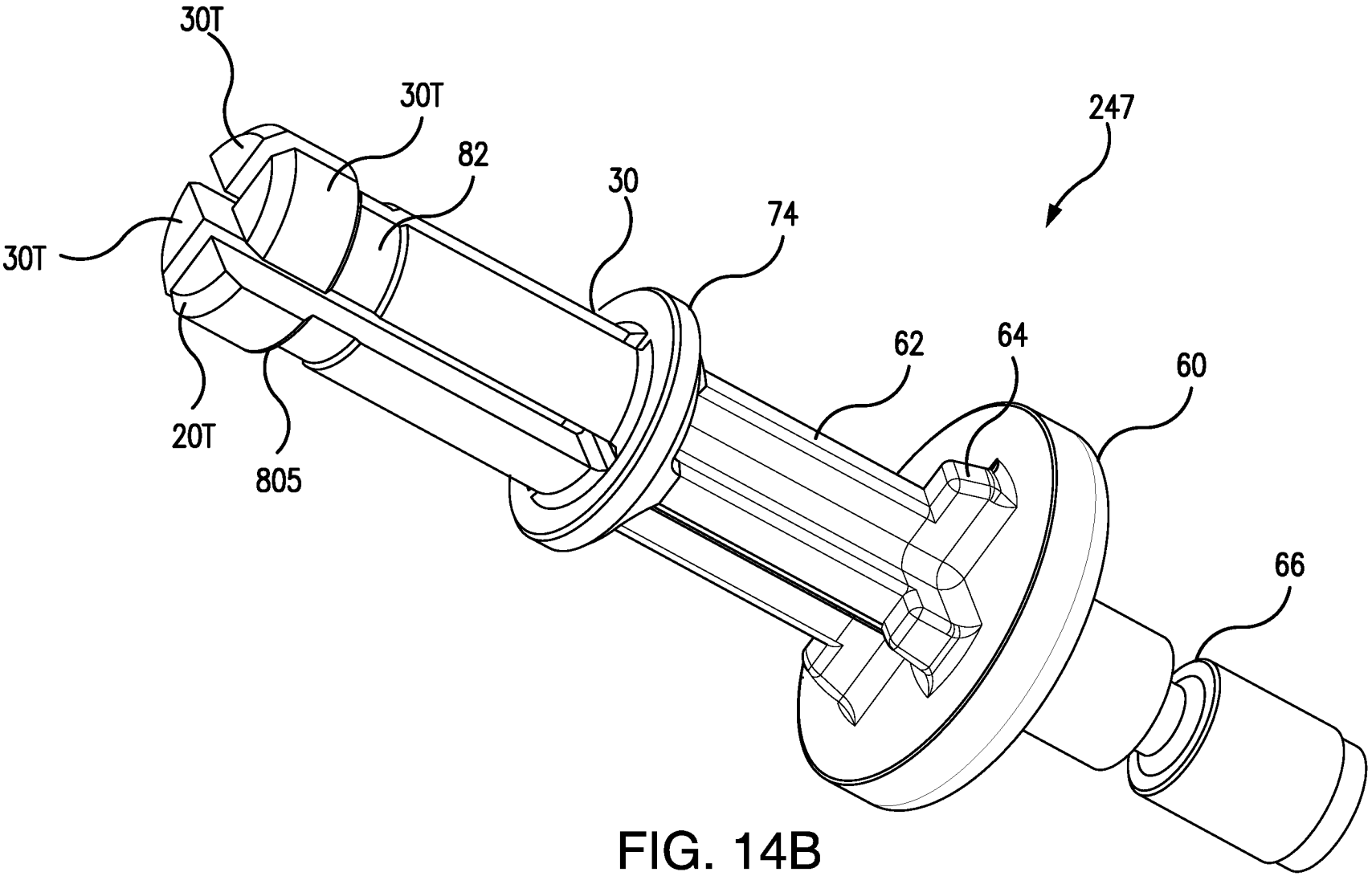
Figure 15A:
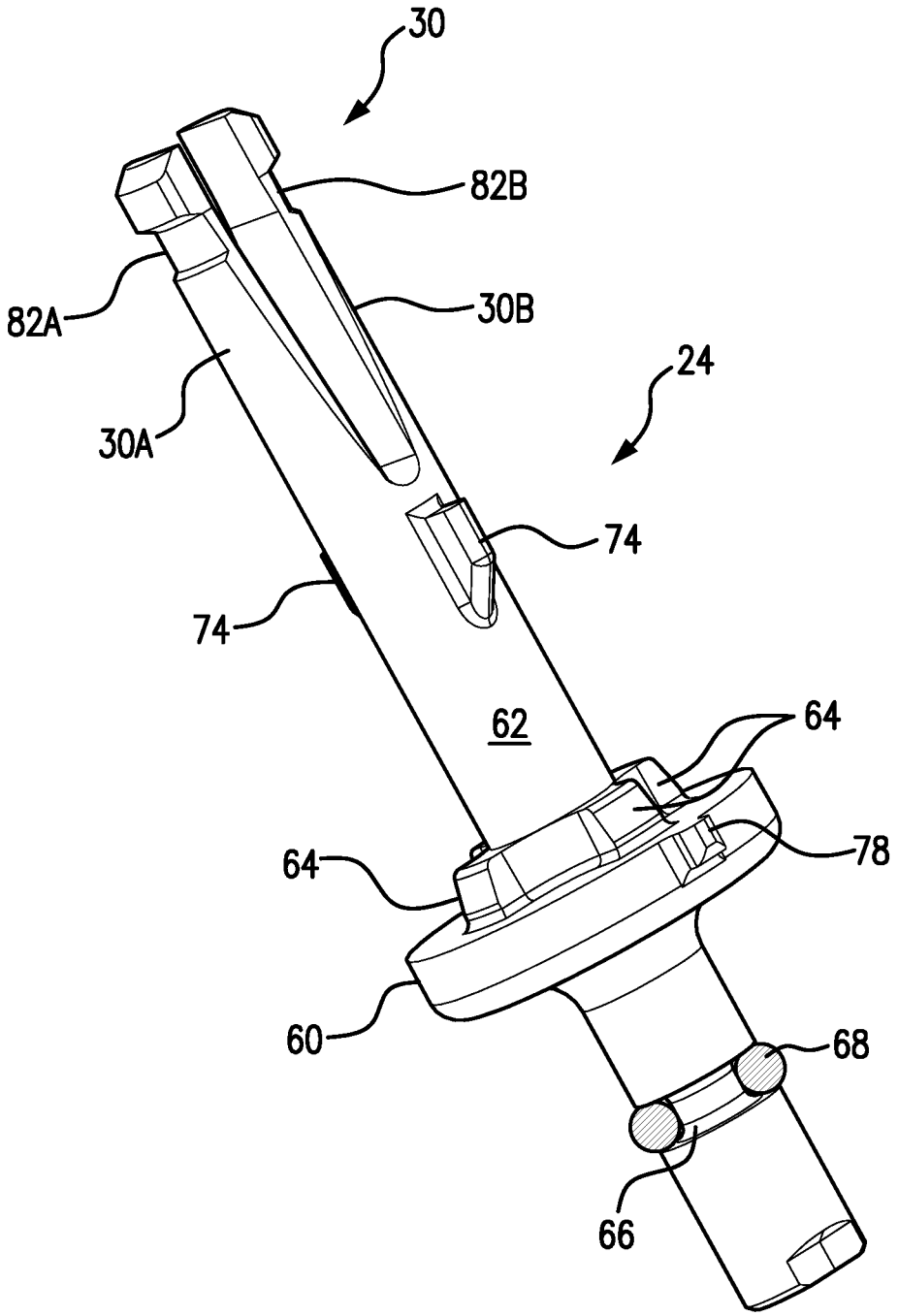
Figure 15B:
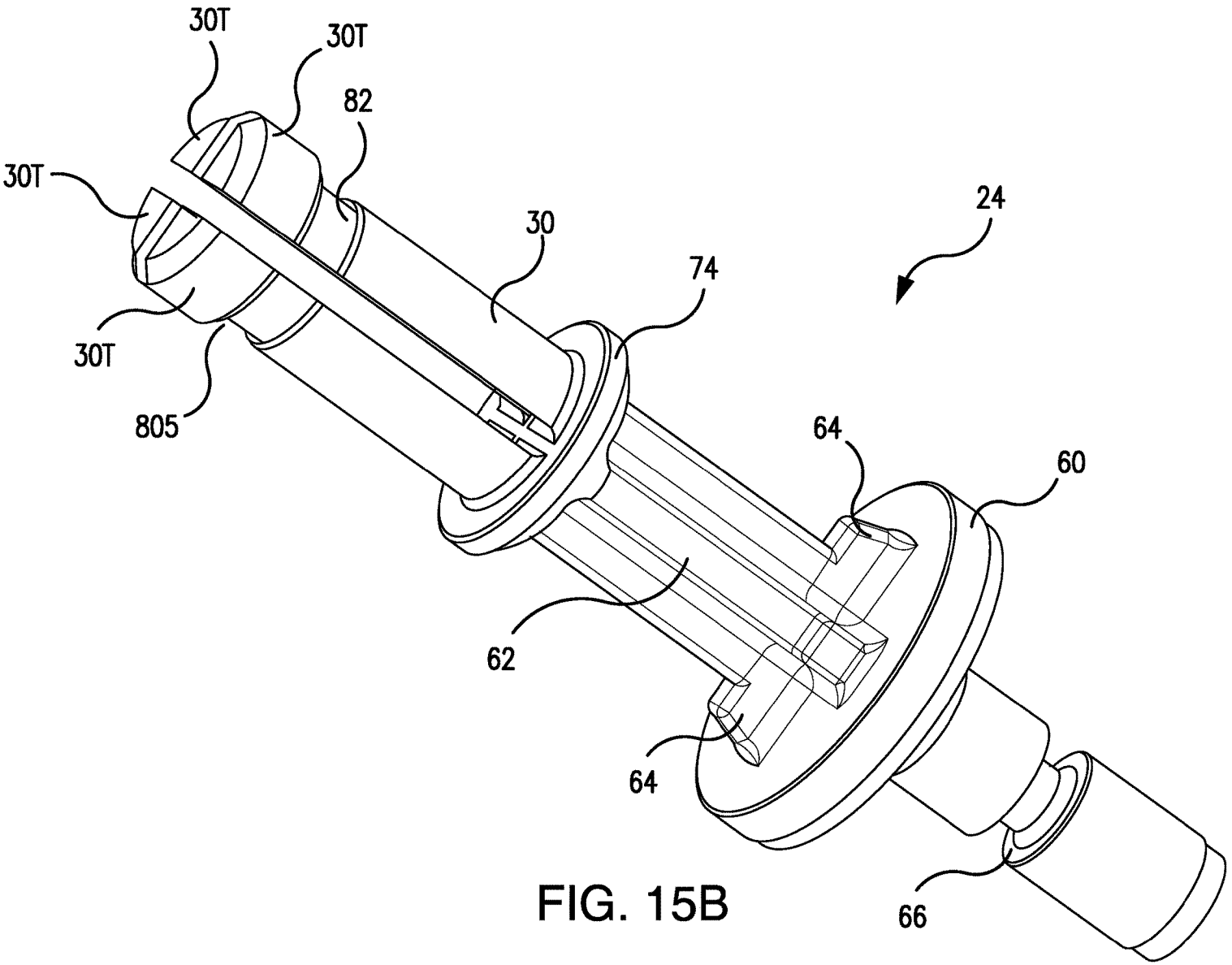
Figure 16:
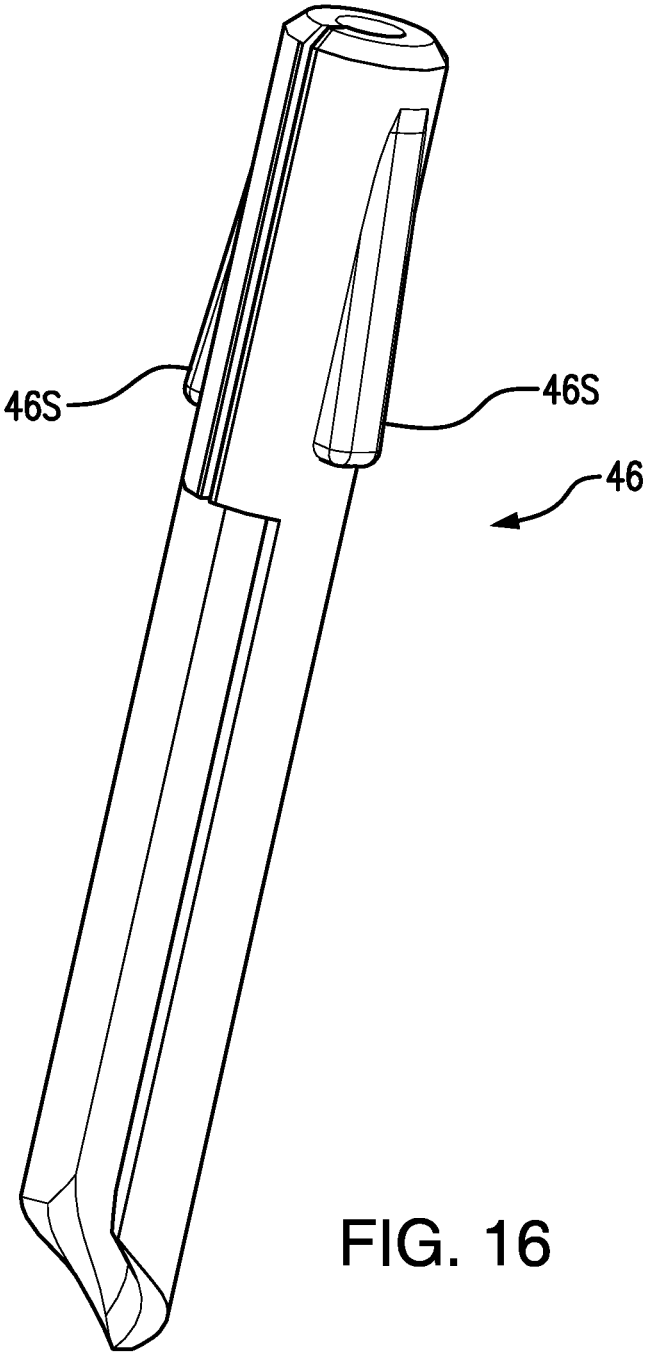
Figure 17:
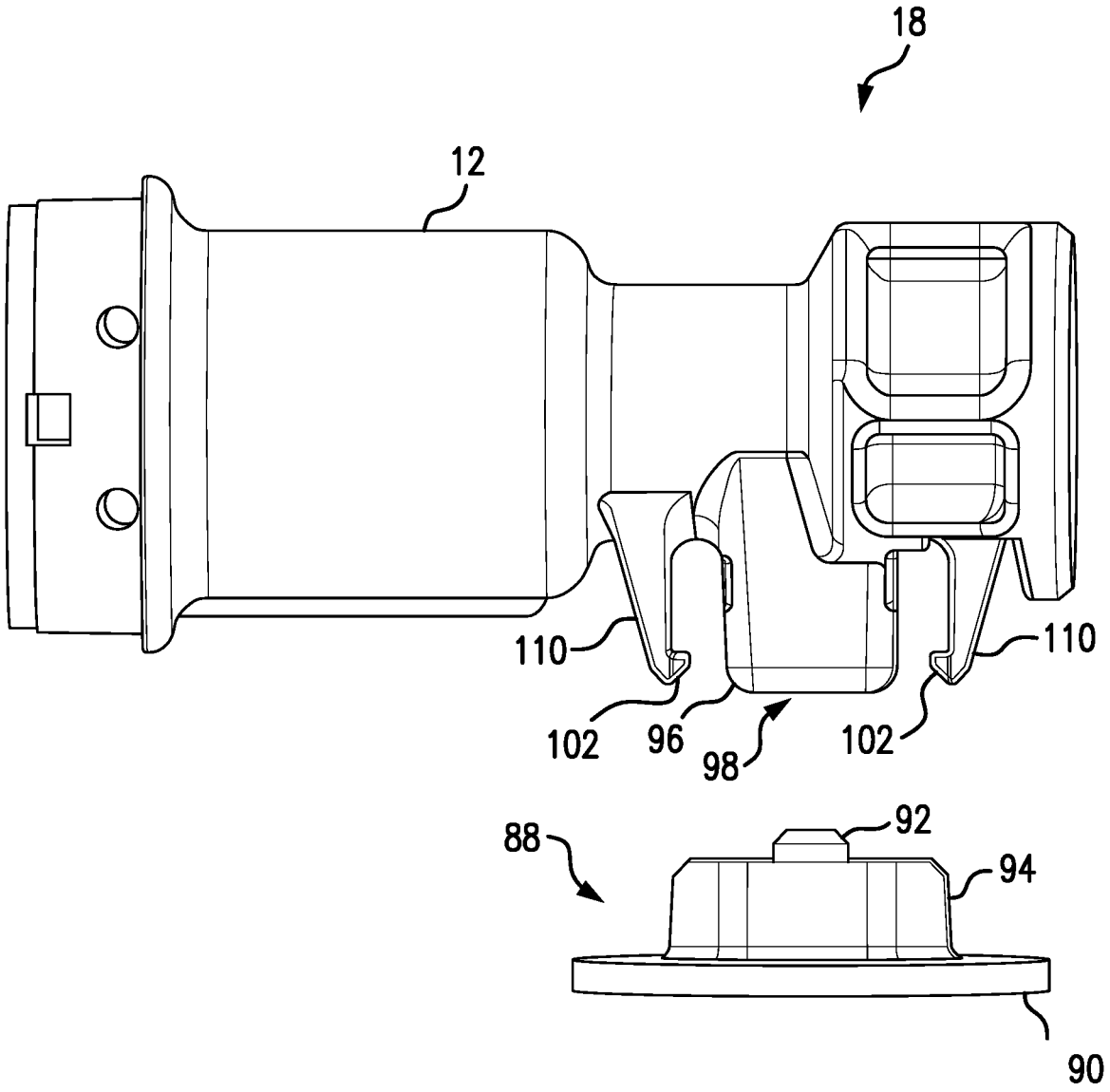
FIGS. 17-22 illustrate the first embodiment of the manifold assembly of the inflator of the invention.
Figure 18:
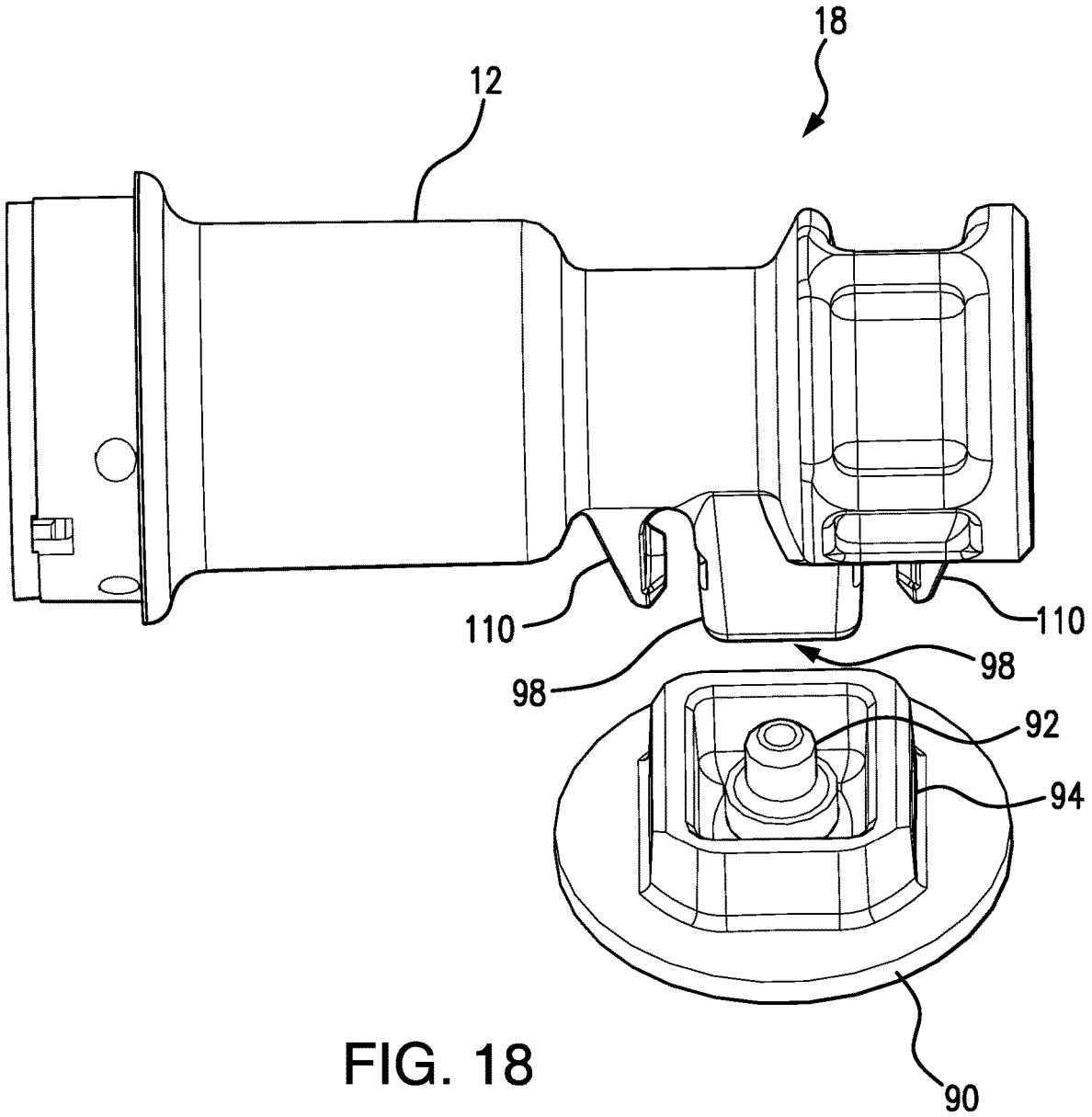
Figure 19:
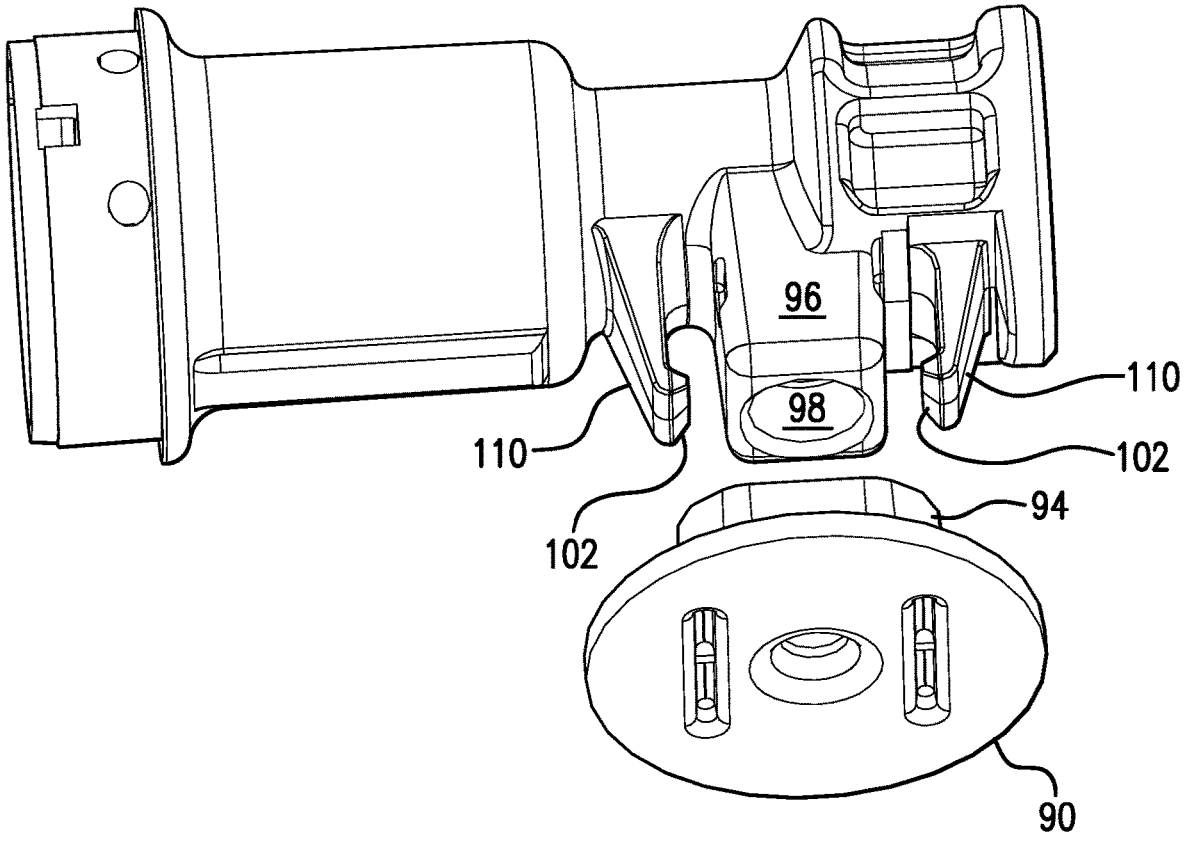
Figure 20:
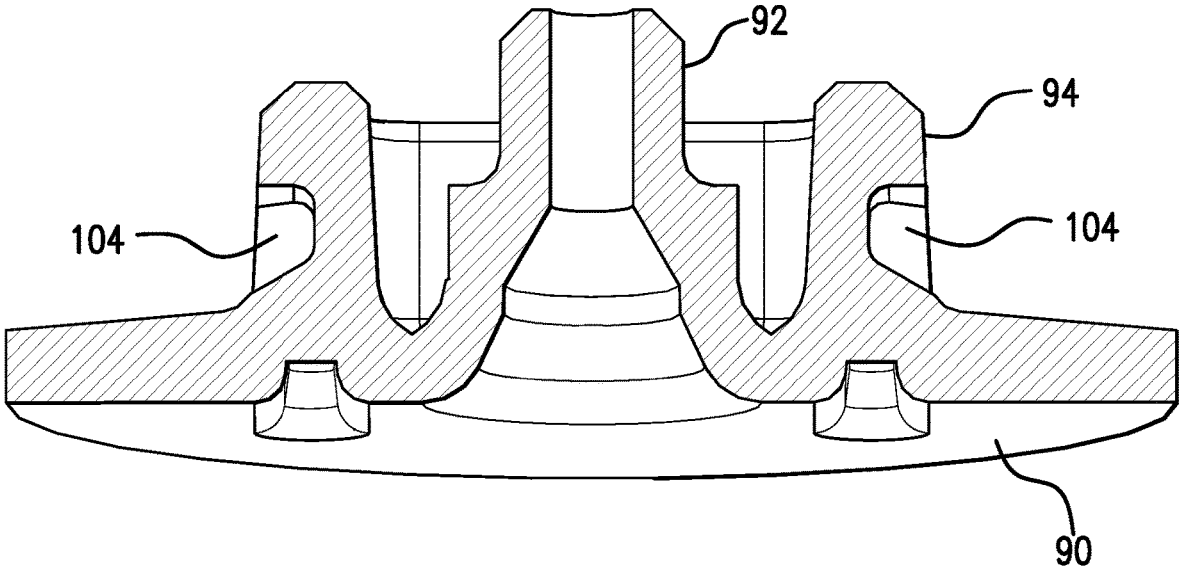

As best shown in FIG. 6A, in the first embodiment the forked end 30 of the actuator 24 comprises two resilient tines 30T whose sides are tapered toward the actuator assembly 18. The tines 30T of the fork end 30 each comprise a notch 82 that is configured and dimensioned to engage onto the inner annular seat 84 formed on the end of the ring seat 32.

As best shown in FIG. 6B, in the second embodiment the forked end 30 of the actuator 24 comprises four resilient tines 30T, collectively formed in a circular configuration to eliminate the need for the ring seat 32 as in the case of the first embodiment. The sides of the four tines 30T are tapered toward the actuator assembly 18. The four tines 30T of the fork end 30 each comprise a notch 82.

In the first embodiment, it is noted that when the inflator 10 is at rest, ready to be fired, the axial tab 28 of the hood 26 positioned between the two tines 30T keeps their notches 82 in engagement with the inner annular seat 84 of the ring seat 32. At the same time, the radial seats 34 of the arms 36 of the bobbin 20 engage the outer seat 86 of the ring seat 32, thereby precluding any movement of the spring-loaded actuator 24 under the force of the spring 44.

Correspondingly, in the second embodiment, it is noted that when the inflator 10 is at rest, ready to be fired, the axial tabs 28 of the hood 26 positioned between the four tines 30T form a circular configuration that keeps their notches 82 in engagement the radial seats 34 of the arms 36 of the bobbin 20, thereby precluding any movement of the spring-loaded actuator 24 under the force of the spring 44.

However, as soon as the hood 26 is manually jerked off the inflator 10 via tether 38 during manual inflation, the axial tab(s) 40 is removed from between the tines 30T. The flexibility of the tines 30T and the matching slopes 80S and 84S of the notches 82 and the inner portion of the seat 84 of the annular ring seat 32 (first embodiment), respectively, allows the tines 30T under the force of the spring 44 to be urged inwardly due to their respective slopes 80S and 84S to fully disengage the forked end 30, whereupon the force of the spring 44 drives the actuator 24 to force its pierce pin 46 into the frangible seal of the gas cartridge.

Similarly, in the first embodiment, during automatic inflation during immersion of the inflator 10 into water to dissolve the pill 22, the arms 36 of the pill 22 are forced outwardly under the force of the spring 44 due to the matching slopes 86S of the outer seat 86 of the ring seat 32 and the inner slope 34S of the radial seats 34. Outward movement of the arms 36 fully releases ring seat 32, whereupon the force of the spring 44 drives the actuator 24 to force its pierce pin 46 into the frangible seal of the gas cartridge.

Correspondingly, in the second embodiment, during automatic inflation during immersion of the inflator 10 into water to dissolve the pill 22, the arms 36 of the pill 22 are forced outwardly under the force of the spring 44 due to the matching slope 80S and the inner slope 34S of the radial seats 34. Outward movement of the arms 36 fully releases the tines 30T, whereupon the force of the spring 44 drives the actuator 24 to force its pierce pin 46 into the frangible seal of the gas cartridge.

As shown in FIGS. 17-22, a first embodiment of the manifold assembly 18 comprises a manifold 88 having a circular flange 90 intended to be sonic-welded (or heat-sealed) to the inflatable. The manifold 88 comprises an upstanding generally cylindrical male boss 92 surrounded by a generally square wall 94. Correspondingly, the manifold assembly 18 comprises on the inflator body 12 a generally square boss 96 having a female opening 98 in fluid communication with the exhaust port 72 of the body 12. Upon insertion of the square wall 96 into the square wall 94 to mate therewith, the female opening 98 is fluidly connected onto the male boss 92 to form a fluid seal therewith utilizing a conventional O-ring. It is noted that the mating square configurations of the square walls 94 and 96 prelude any rotational movement between the inflator body 12 and the manifold 88.

A pair of clips 110 extending downwardly from opposing outer sides of the square boss 96 include barbed projections 102 that engage into corresponding notches 104 in the opposing outer sides of the male boss 92 to seal the female opening 98 in fluid communication with the male boss 92.

Figure 21:
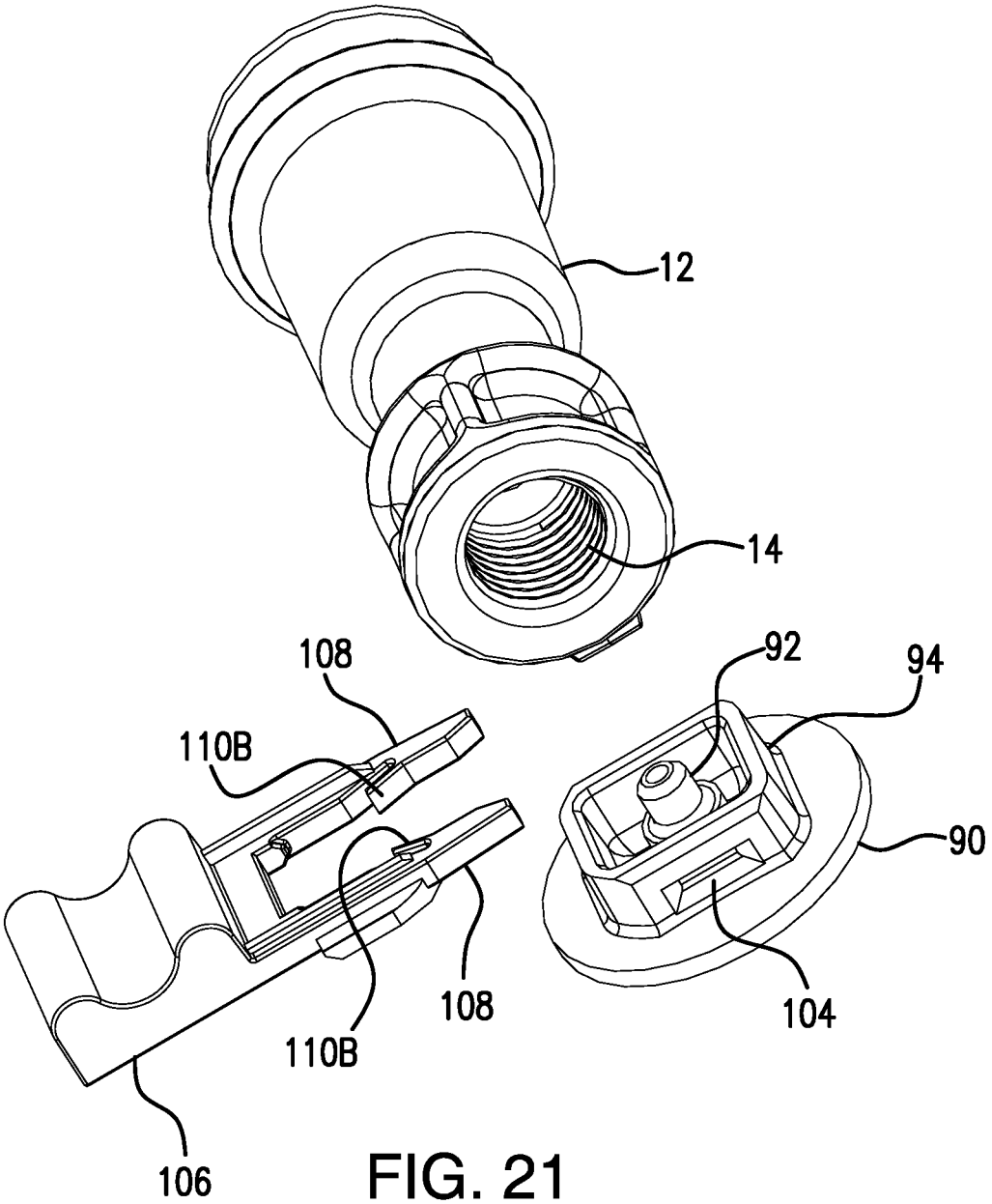
Figure 22:
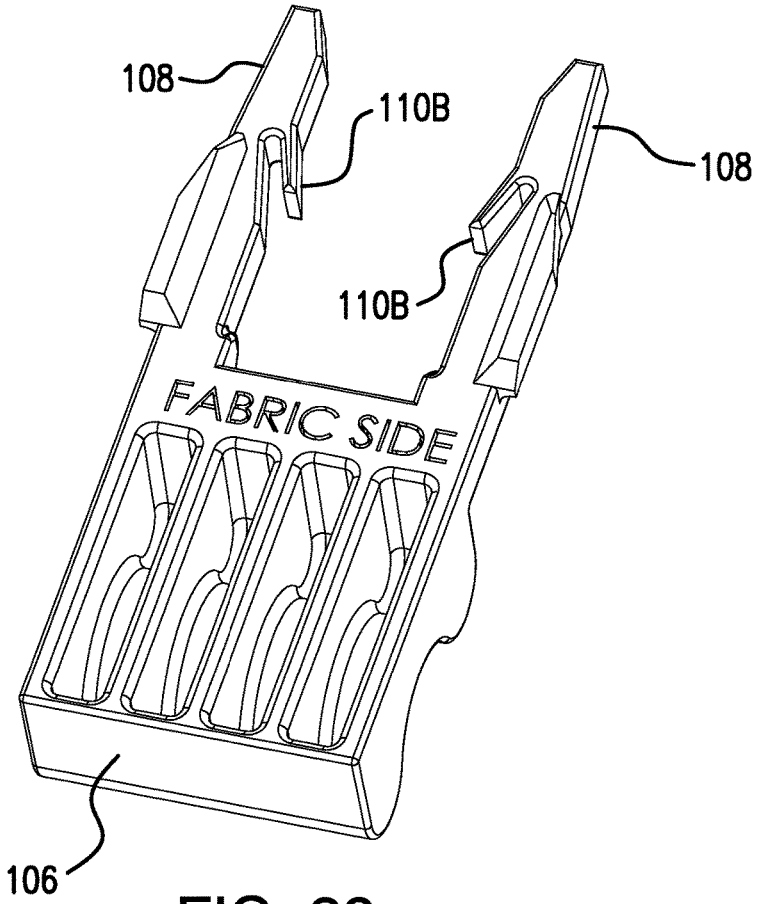
Figure 23A:
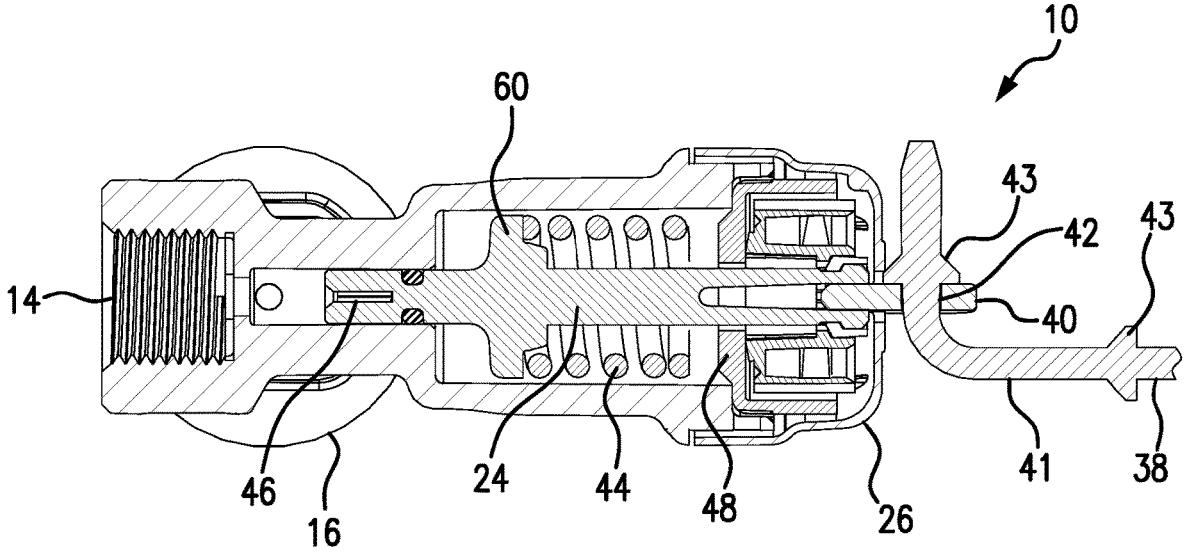
FIG. 23A is a cross-sectional view of a second embodiment of the inflator of the invention.
Figure 24A:
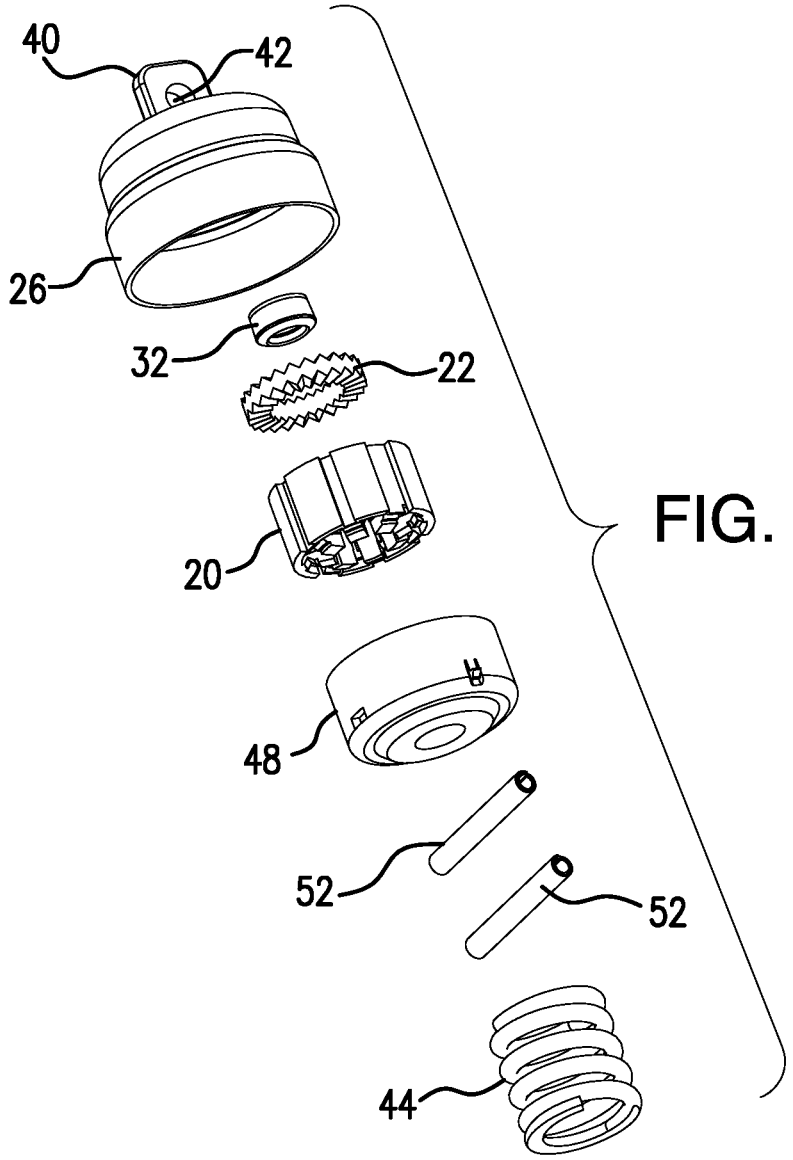
FIG. 24A is an exploded view of FIG. 23.
Figure 25:
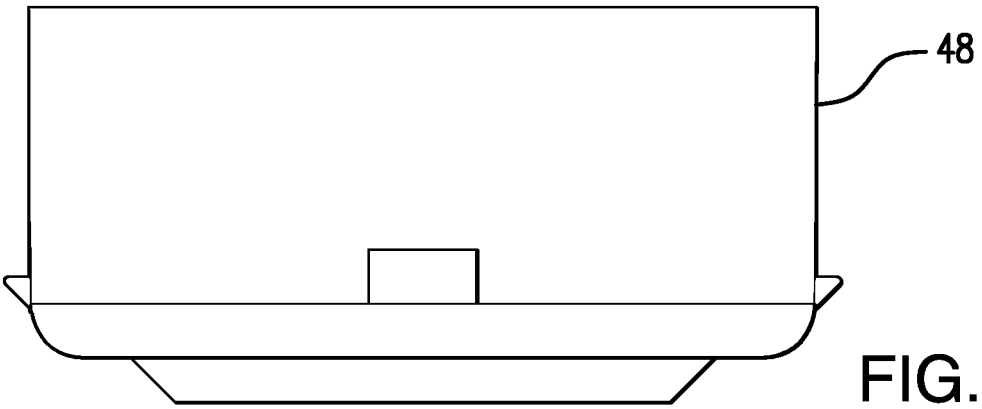
FIGS. 25 and 26 illustrate the bobbin housing of the second embodiment of the inflator of the invention.
Figure 26:
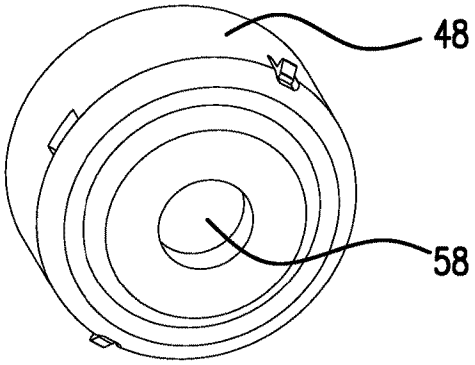
Figure 27A:
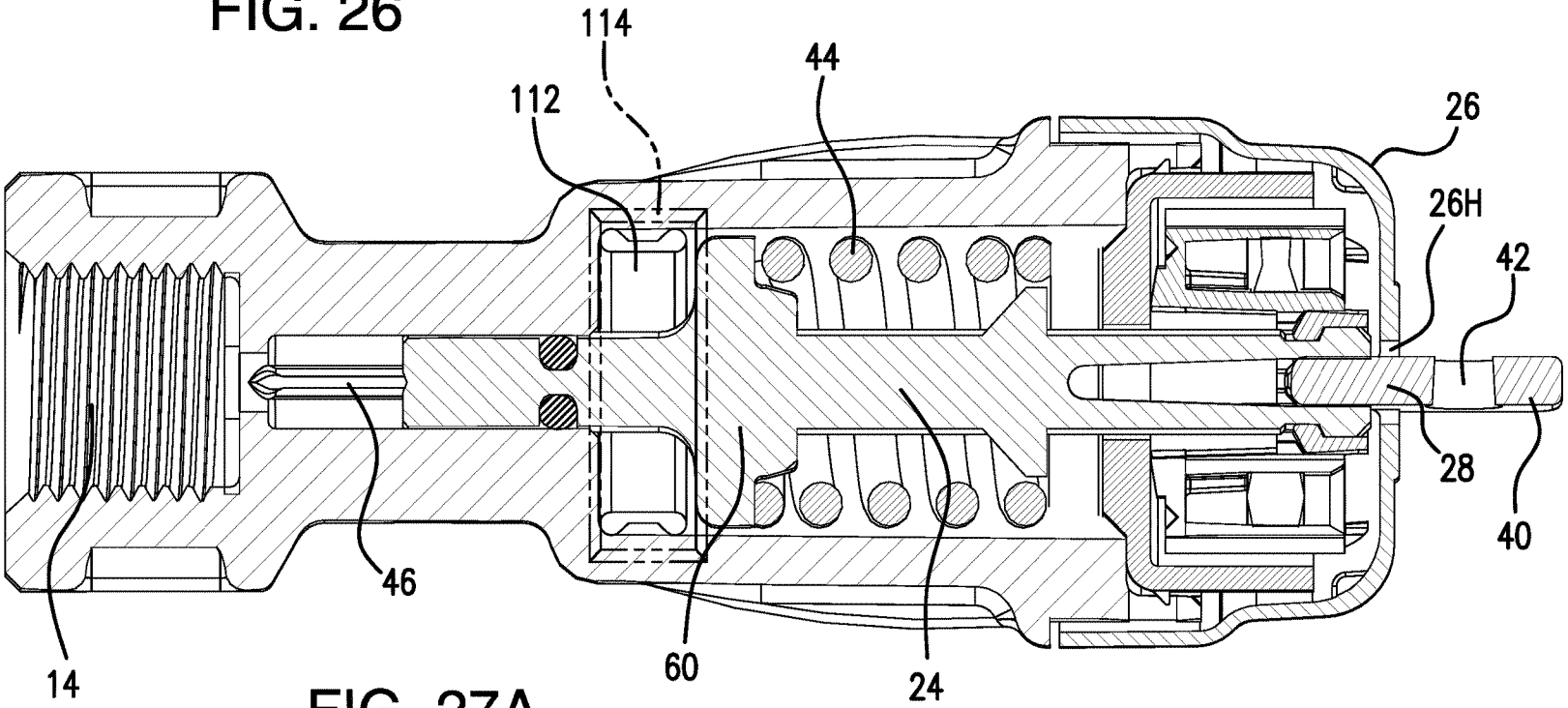
FIGS. 27A and 28A are cross-sectional views of a third embodiment of the inflator of the invention.
Figure 28A:
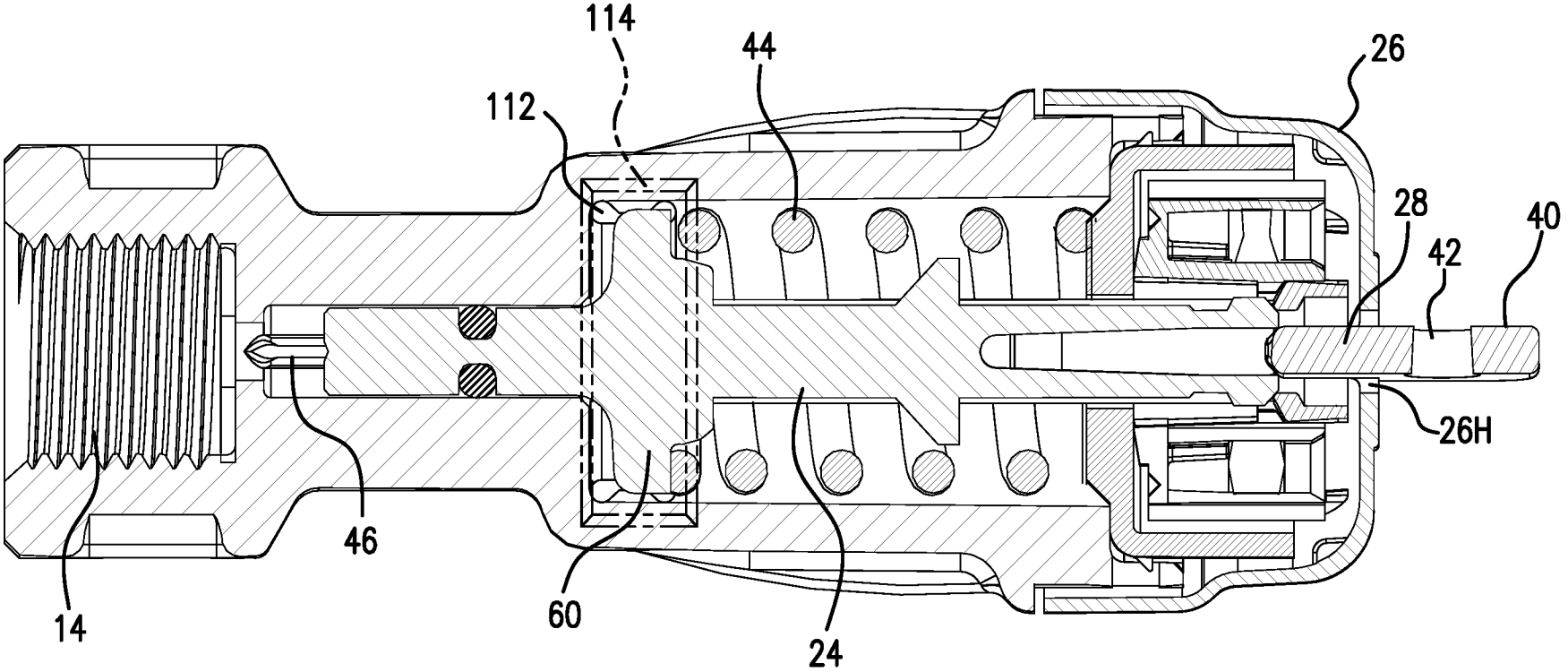
Figure 29:
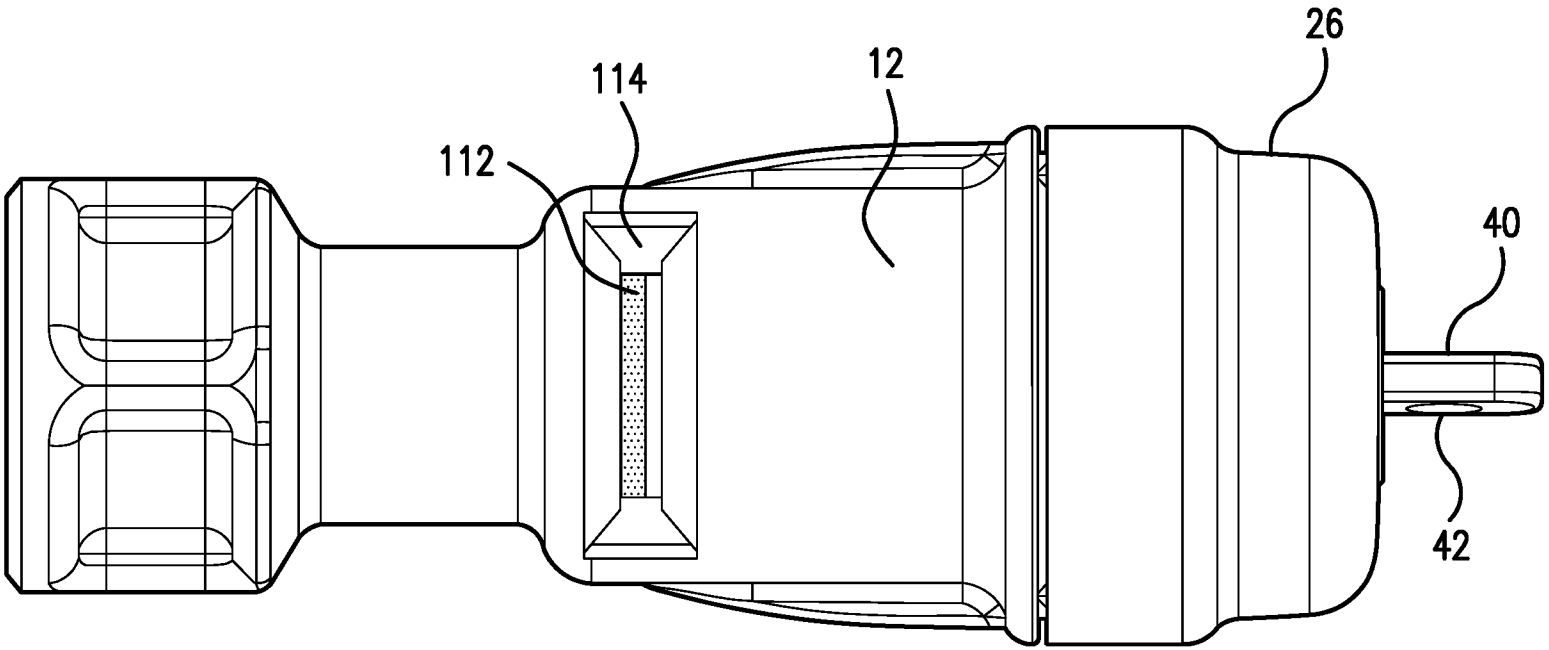
FIGS. 29 and 30 are top views of the third embodiment of the inflator of the invention.
Figure 30:
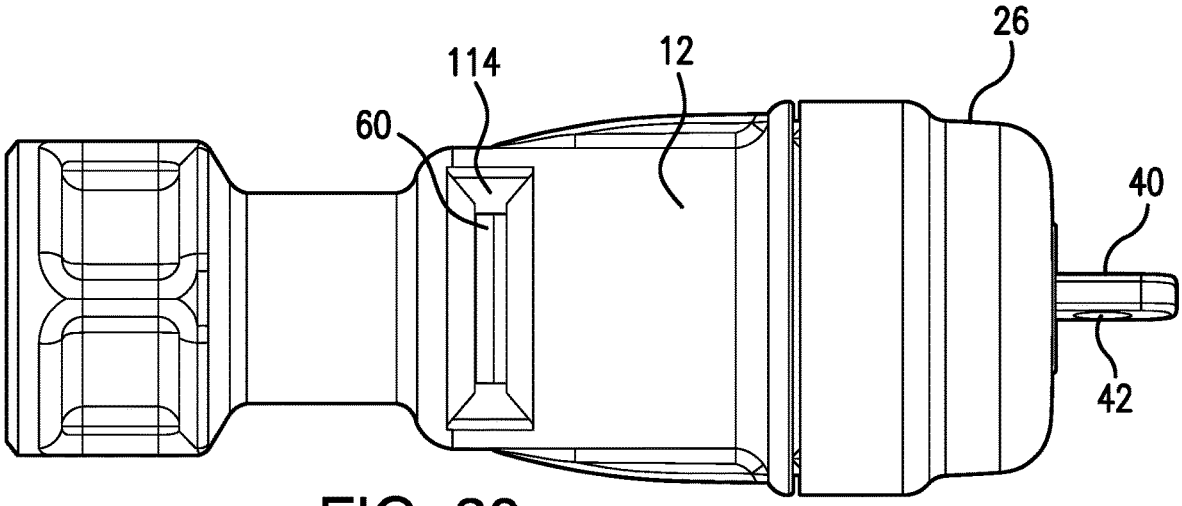
Figure 31A:
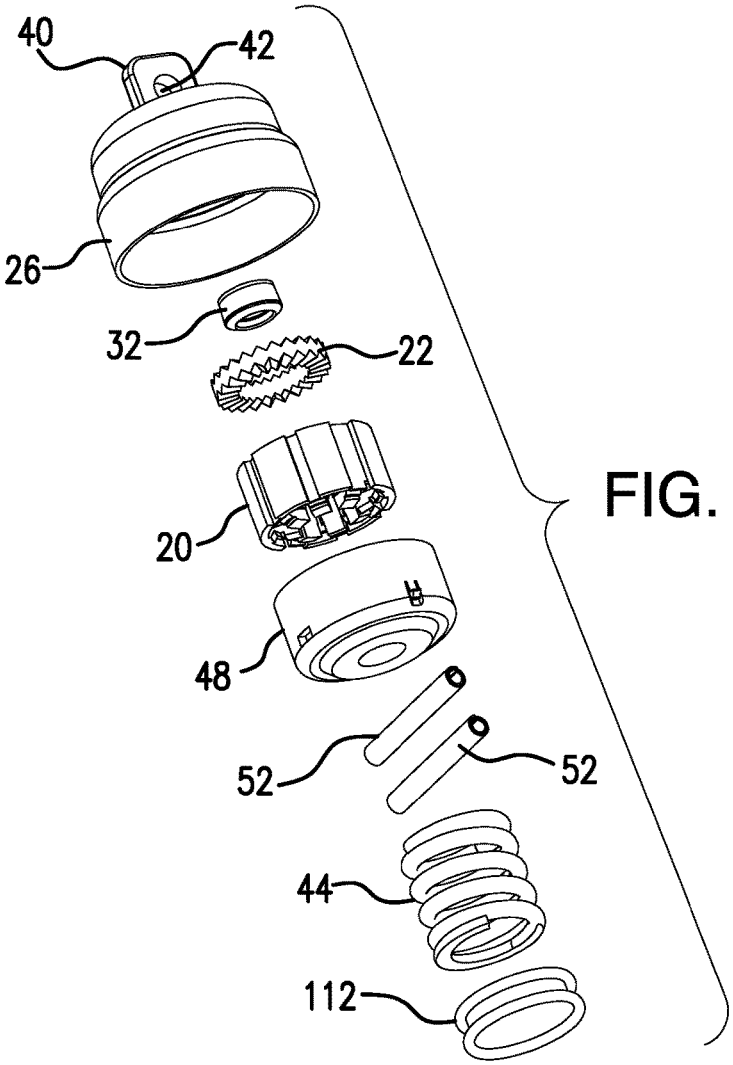
FIG. 31A is an exploded view of the third embodiment of the inflator of the invention.

After firing, the spent inflator 10 may be removed by a user through the use of a removal key 106. As best shown in FIGS. 21 and 22, in one embodiment the removal key 106 comprising opposing arms 108 that engage between the clips 110 and the opposing outer sides of the square boss 92 to forcibly sufficiently widen the distance between the clips 110 to disengage their barbed projections 102 from their respective notches 104, allowing the spent inflator 10 to be removed so that a new one may be installed.

Optionally to preclude reuse of the removal key 106, the opposing arms 108 may each include a retention barb 110B such that upon installation to remove the spent inflator 10, the retention barbs 110B keep the key 106 in place between the clips 110 on the inflator body 12. The removal key 106 is therefore rendered non-reusable because it cannot be removed from the spent inflator 10. Correspondingly, the spent inflator 10 is rendered non-reusable due to the fact that the non-removable key 106 keeps the distance between the clips 110 too far apart such that their barbed projections 102 cannot engage their respective notches 104. Indeed, if the user tries to re-install the spent inflator 10, it would simply fall off.

It is anticipated that the non-reusable removal key 106 would be colored red to indicate the inoperable condition of the spent inflator 10. It is envisioned that each new disposable inflator 10 would be sold with a removal key 106 facilitating the removal of the spent inflator 10 by the user from the manifold 88 molded to the inflatable. The new disposable inflator 10 could then be installed onto the manifold 88.

As shown in FIGS. 27 and 28, a window 114 allows a user to view either a colored indicator 112 (e.g., green) as in FIG. 27 or the ledge 60 (e.g., colored red) as in FIG. 28. The colored indicator 112 is a different color than that of the ledge 60 (e.g., green versus red) for the purpose of allowing the user to determine that the inflator has been cocked in condition-ready mode or in the fired or condition-not-ready mode. When in the cocked position, as shown in FIG. 27, the colored indicator 112 is viewable through the window 114. When the inflator is fired, as shown in FIG. 28, the colored indicator 112 is forcibly compressed by the ledge 60 towards the direction of the threaded input 14. This change in position is achievable by having the colored indicator 112 being composed of readily compressible materials such as silicone or foam. The compressible colored indicator 112 also functions to seal-off the window 114 to prevent water such as rainfall from being splashed therethrough.

Upon firing of the inflator 10, the red-colored ledge 60 compresses the green-colored indicator 112 from its original uncompressed position shown in FIG. 27, whereupon the red-colored ledge 60 is now viewable through the window 114 (see FIG. 28), visually indicating a fired condition. Thus, once the user views the change in color, she knows that the inflator has been fired, is no longer operational and should be disposed of.

Figure 32:
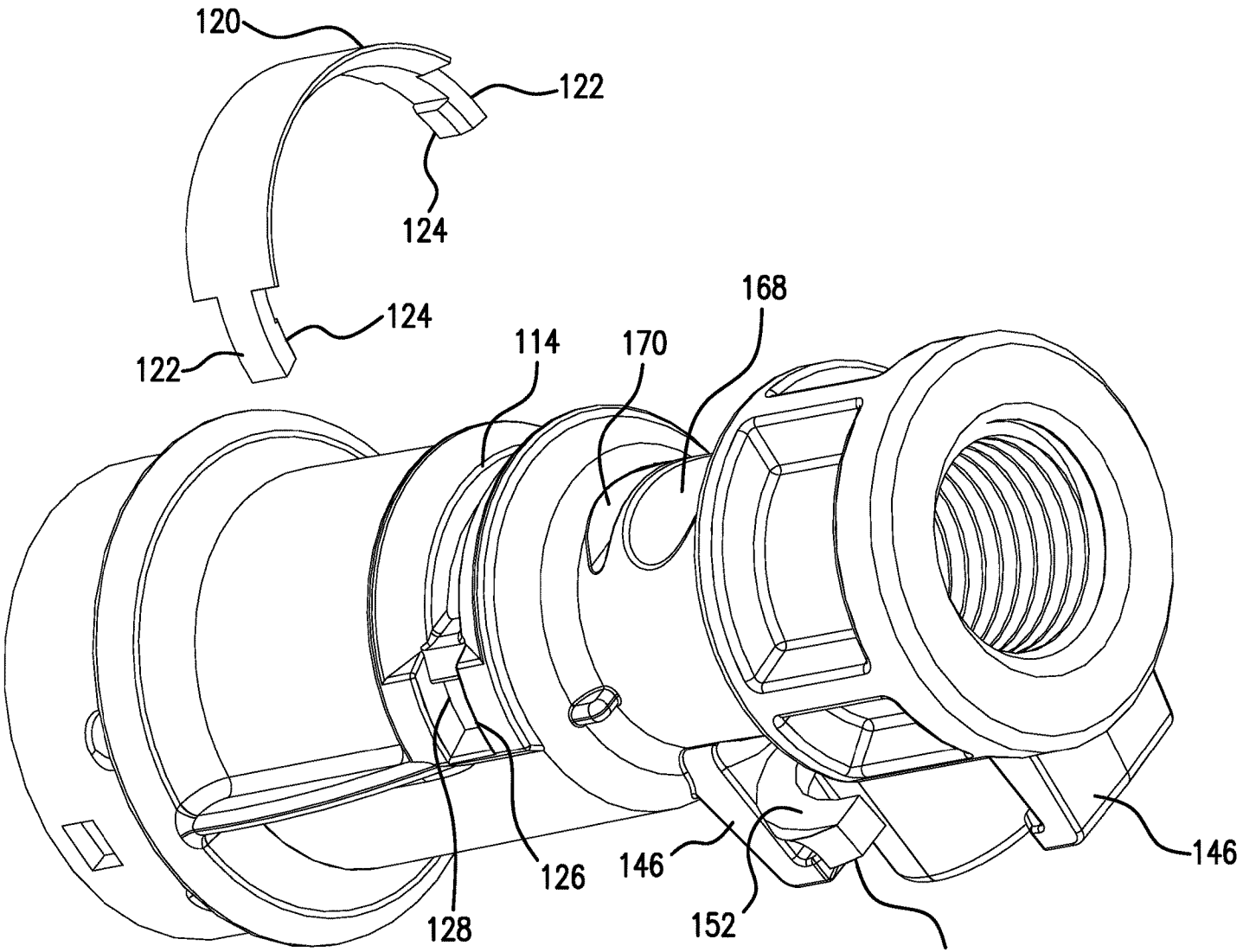
FIG. 32 is an exploded, perspective view of the see-through lens that seals the indicator window to prevent water from entering the window.
Figure 33:
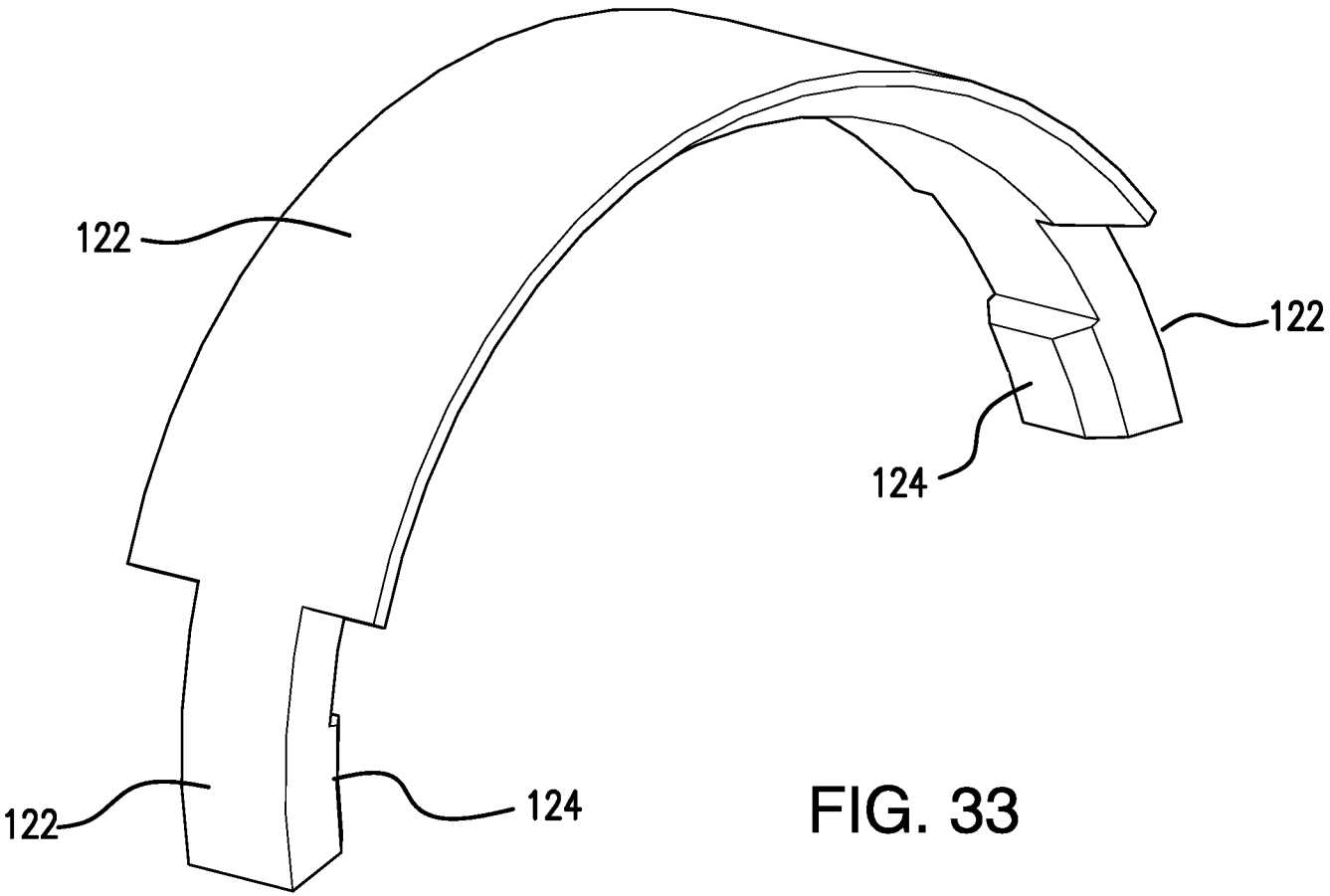
FIG. 33 is an enlarged perspective view of the see-through lens.
Figure 35:
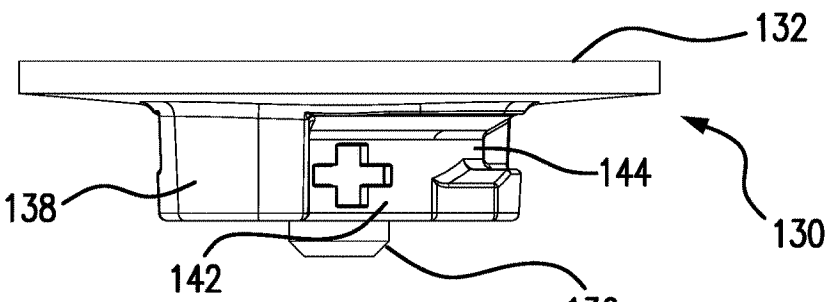
FIG. 35 is a side view of the manifold.
Figure 34:
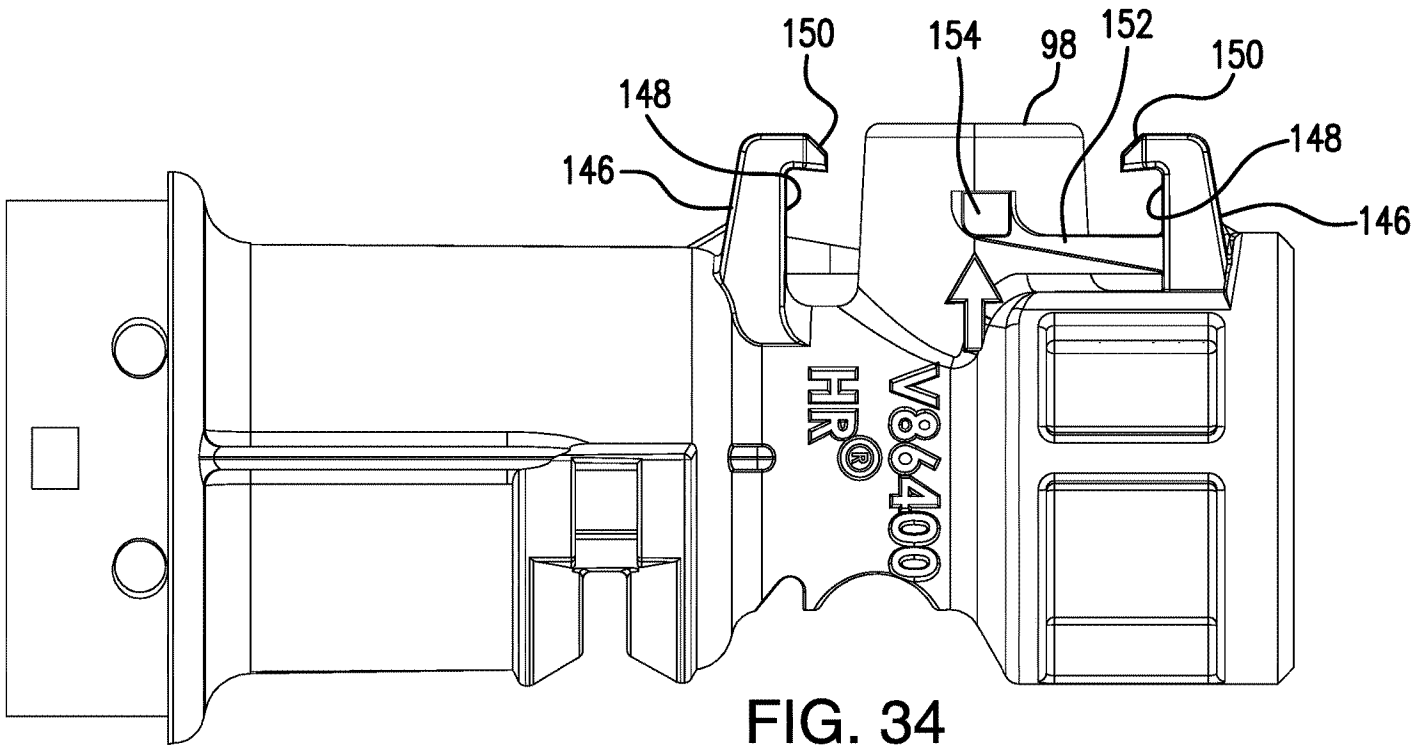
FIG. 34 is a side view of one embodiment of manifold assembly of the invention.
Figure 36:
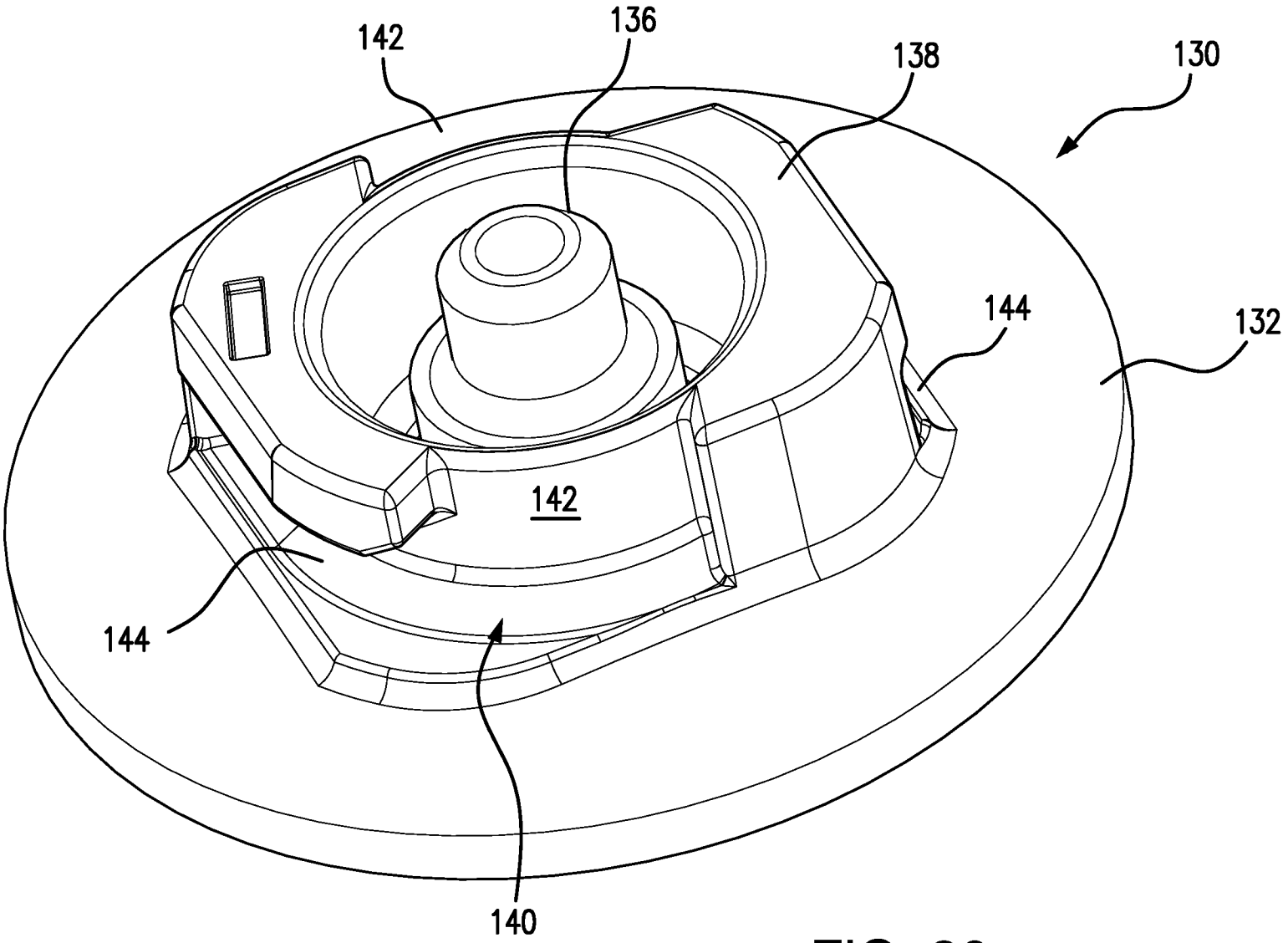
FIG. 36 is a perspective view of the manifold.
Figure 37:
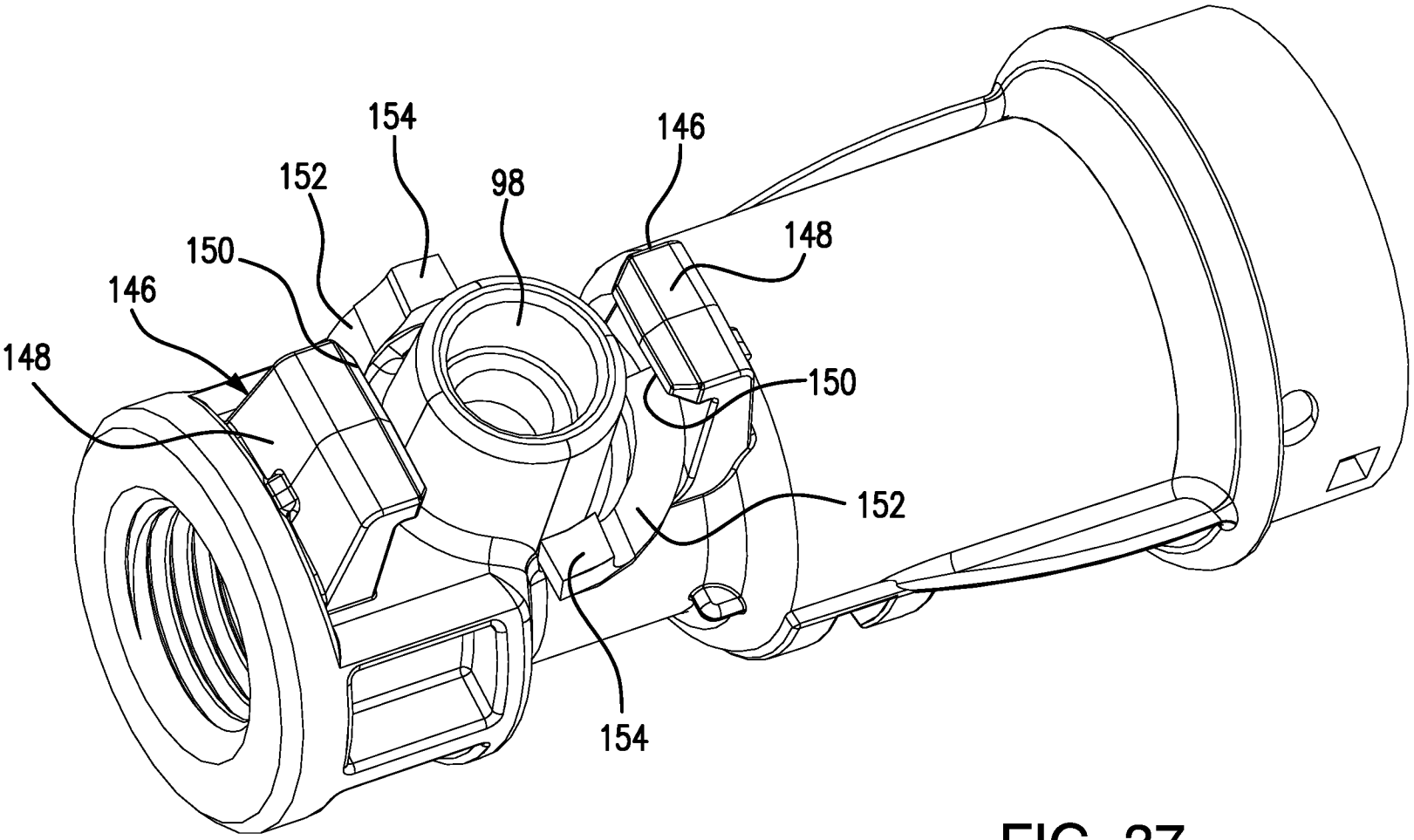
FIGS. 37 and 38 are perspective views of FIG. 34.
Figure 38:
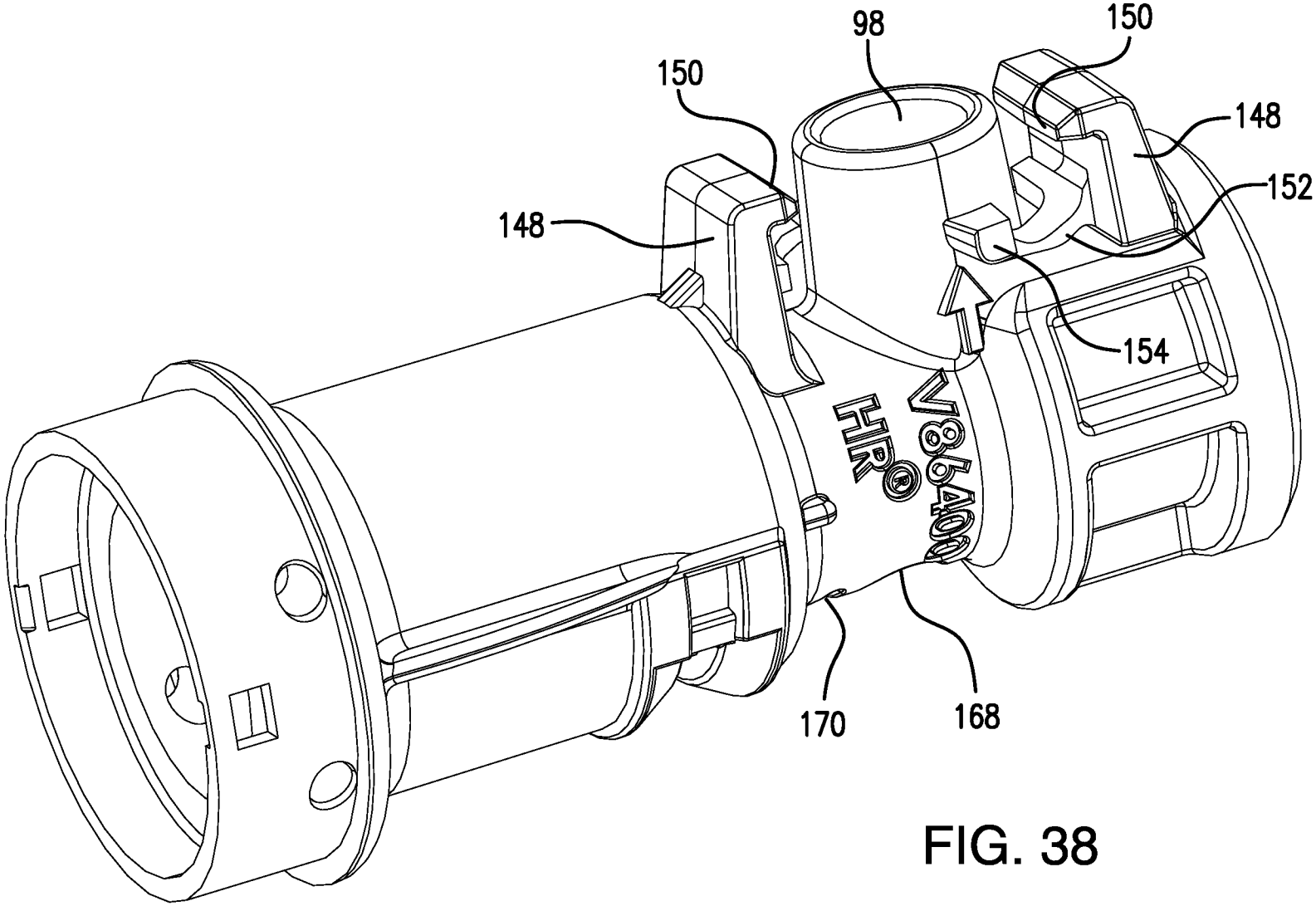
Figure 39:
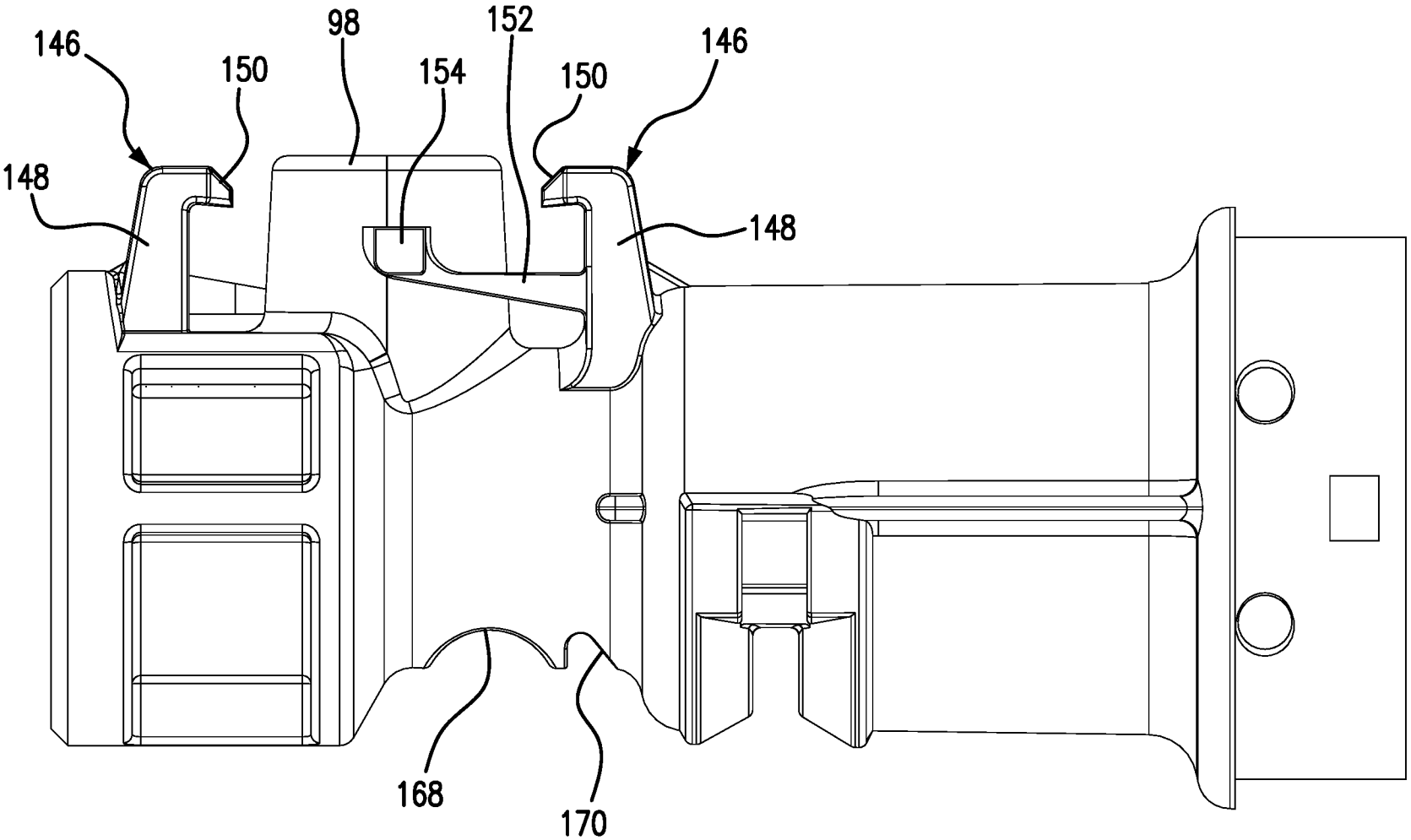
FIGS. 39 and 40 are elevational views of the manifold assembly.
Figure 40:
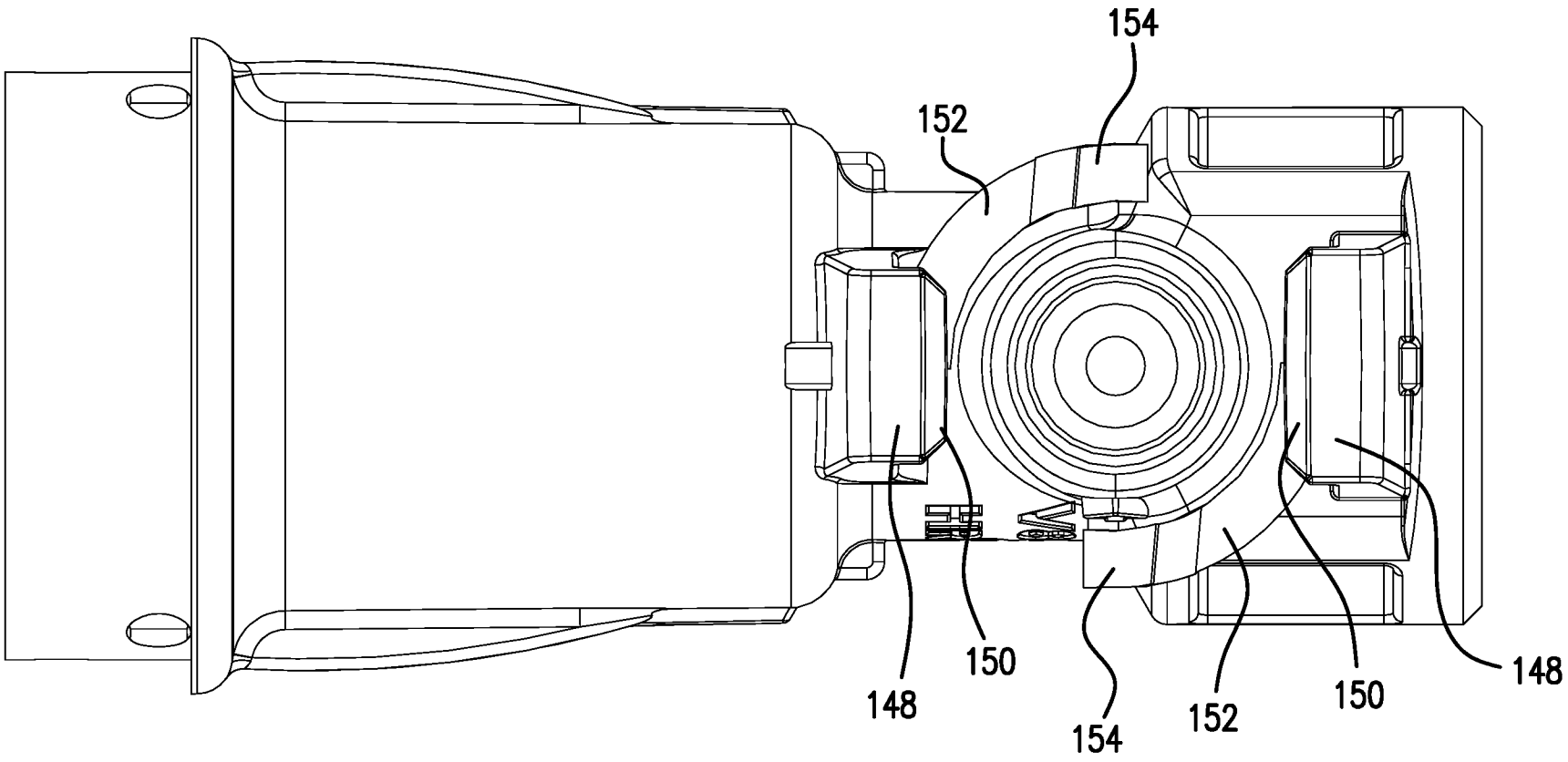
Figure 41:
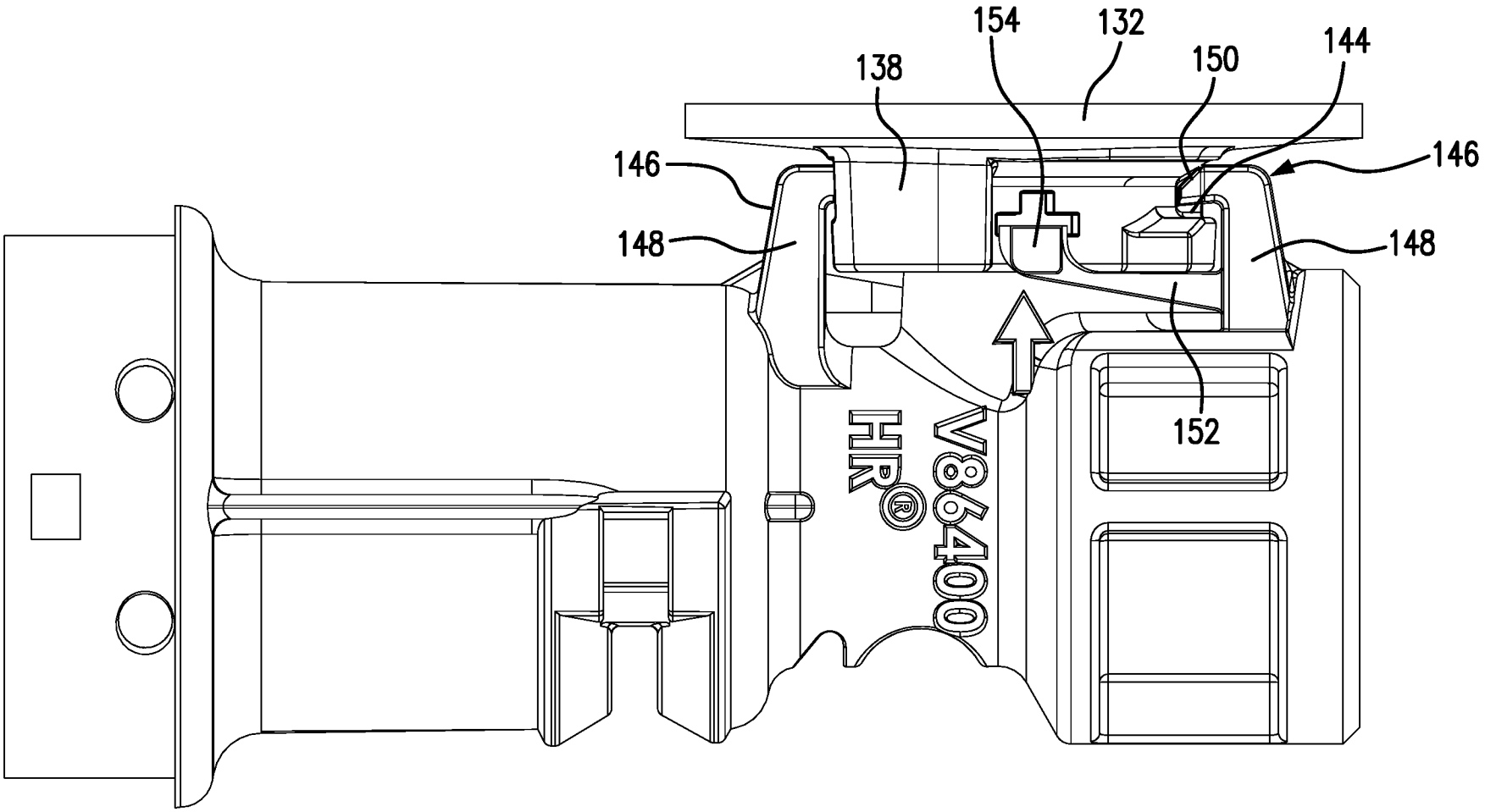
FIG. 41 is an elevational view of the manifold assembly installed to the manifold.

To preclude the compressible colored indicator 112 from potentially being lodged in the window 114 upon firing, the colored indicator 112 is preferably recessed from the window 114. However, when the colored indicator 112 is so recessed, it no longer seals off the window 114 to prevent water from entering the inflator 10 via the window 114. As shown in FIGS. 32 and 33, a visually clear, see-through lens 120 is snap-fitted about the window 114 to prevent water from entering the inflator 10 while allowing viewing, through the lens 120, of the green-colored colored indicator 112 before firing of the inflator 10 and the red-colored ledge 60 after firing.

The lens 120 comprises an arcuate portion 122 configured and dimensioned to closely fit over the window 114 to seal therewith. The lens 120 is retained in position over the window 114 by opposing arms 122 each with protrusions 124 extending radially inward. The arms 122 are configured fit into corresponding slots 126 formed in the inflator body 12 at opposing sides of the window 114. The inwardly-extending protrusions 124 are configured to snap-fit into corresponding indentations 128 formed in the bottoms of the slots 126, thereby securing the lens 120 into position over the window 114.

In a second embodiment of the manifold assembly 16 is shown in FIGS. 34-45. In this second embodiment, the inflator body 12 comprises a manifold 130 having a circular flange 132 intended to be sonic welded (or heat-sealed) to the inflatable. The manifold 130 comprises an upstanding generally cylindrical male boss 136 surrounded by a generally square wall 138. The outside of the square wall 138 comprises a pair of opposing lug notches 140 each composed of a vertically extending insertion notch 142 and a horizontal arcuate notch 144. Correspondingly, the manifold assembly 18 comprises on the inflator body 12 a pair of opposing lugs 146 each composed of a vertically extending lug portion 148 with an inwardly extending tab portion 150. The lug portion 148 is configured and dimensioned slide into the insertion notch 142 of the manifold 130 whereas the tab portion 150 is configured and dimensioned to slide rotationally into to the arcuate notch 144 thereof.

To secure the inflator 10 to the manifold 130, the user aligns the female opening 98 with the male boss 136 and mates the two, whereupon the vertical lug portion 148 slides into the vertical notch 142. The user then rotates the inflator 10 about one-eighth of a turn whereupon the tab 150 moves rotationally into the arcuate notch 144, thereby securing the inflator 10 to the inflator 130.

The inflator body 12 comprises a pair of opposing resilient arcuate arms 152 extending from their respective lugs 146. The end of each arm 152 includes a lock protrusion 154. The curve of the arcuate arms 152 and their lock protrusions 154 are configured and dimensioned such that the lock protrusions 154 engage the top surface of the wall 138 of the manifold 130 then resiliently flex toward the inflator body 12 as the female opening 98 is pushed onto the male boss 136 of the manifold 130. As the inflator 10 is rotated about one-eighth of a turn, the lock protrusions 154 slide off the top surface of the wall 138 and snap into the vertical notch 144 of the manifold 130. The lock protrusions 154 therefore prevent any counter-rotation of the inflator 10 relative to the manifold 130. The inflator 10 is thus secured to the manifold 130 and cannot be removed by the user without a removal tool because counter-rotation is precluded by the lock protrusions 154.

Figure 42:
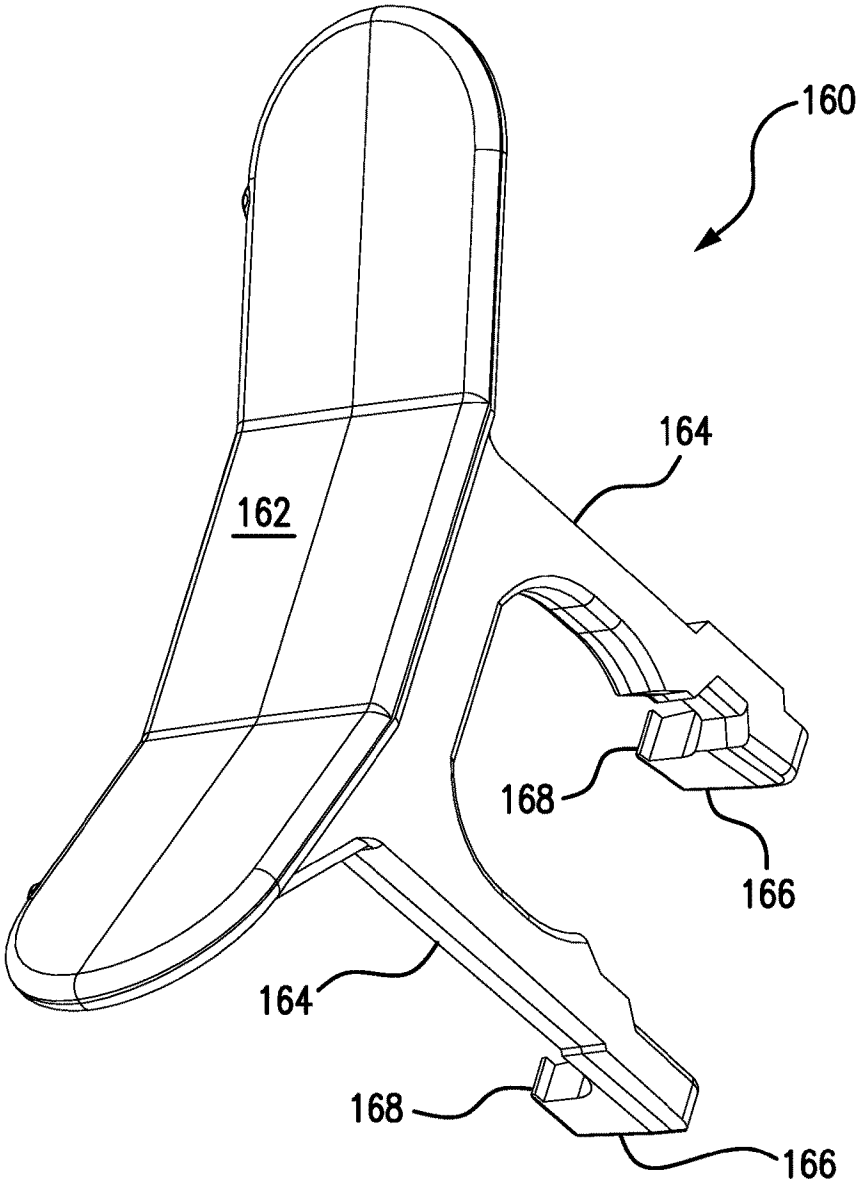
FIGS. 42 and 43 are perspective views of the removal key intended for use with the manifold assembly of FIGS. 34 and 36-41.
Figure 43:
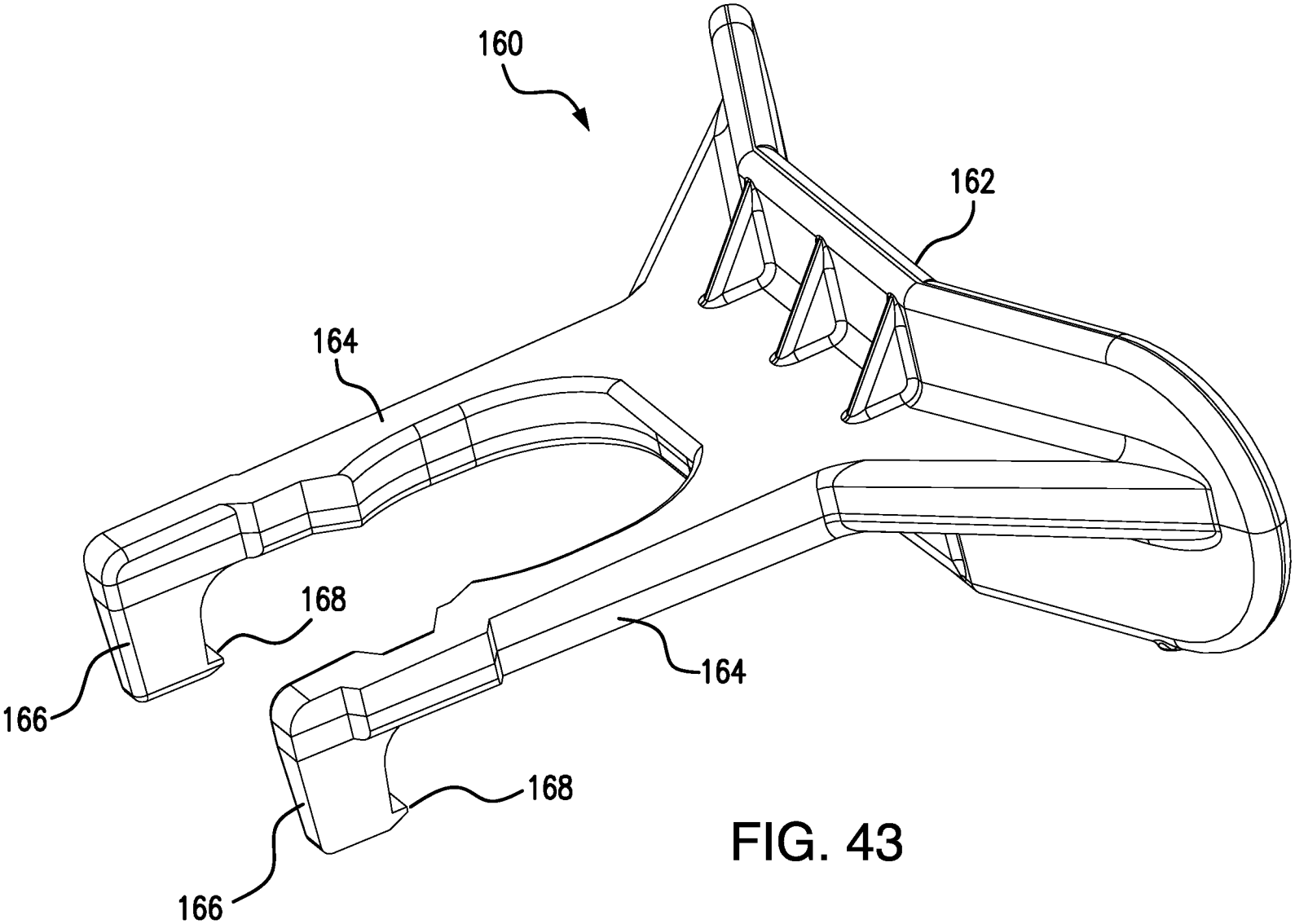
Figure 44:
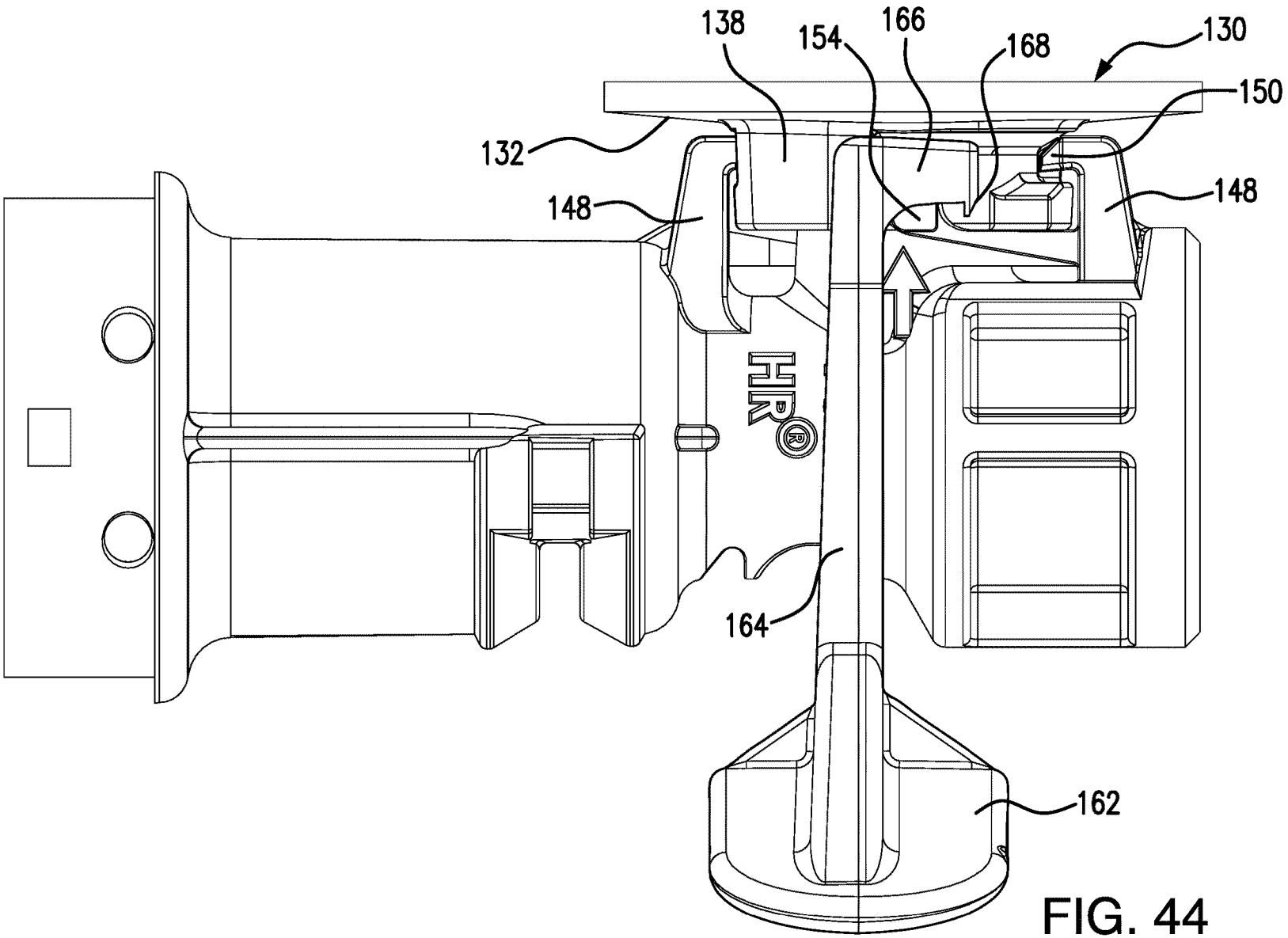
FIG. 44 is an elevational view showing the removal key installed on the manifold assembly.
Figure 45:
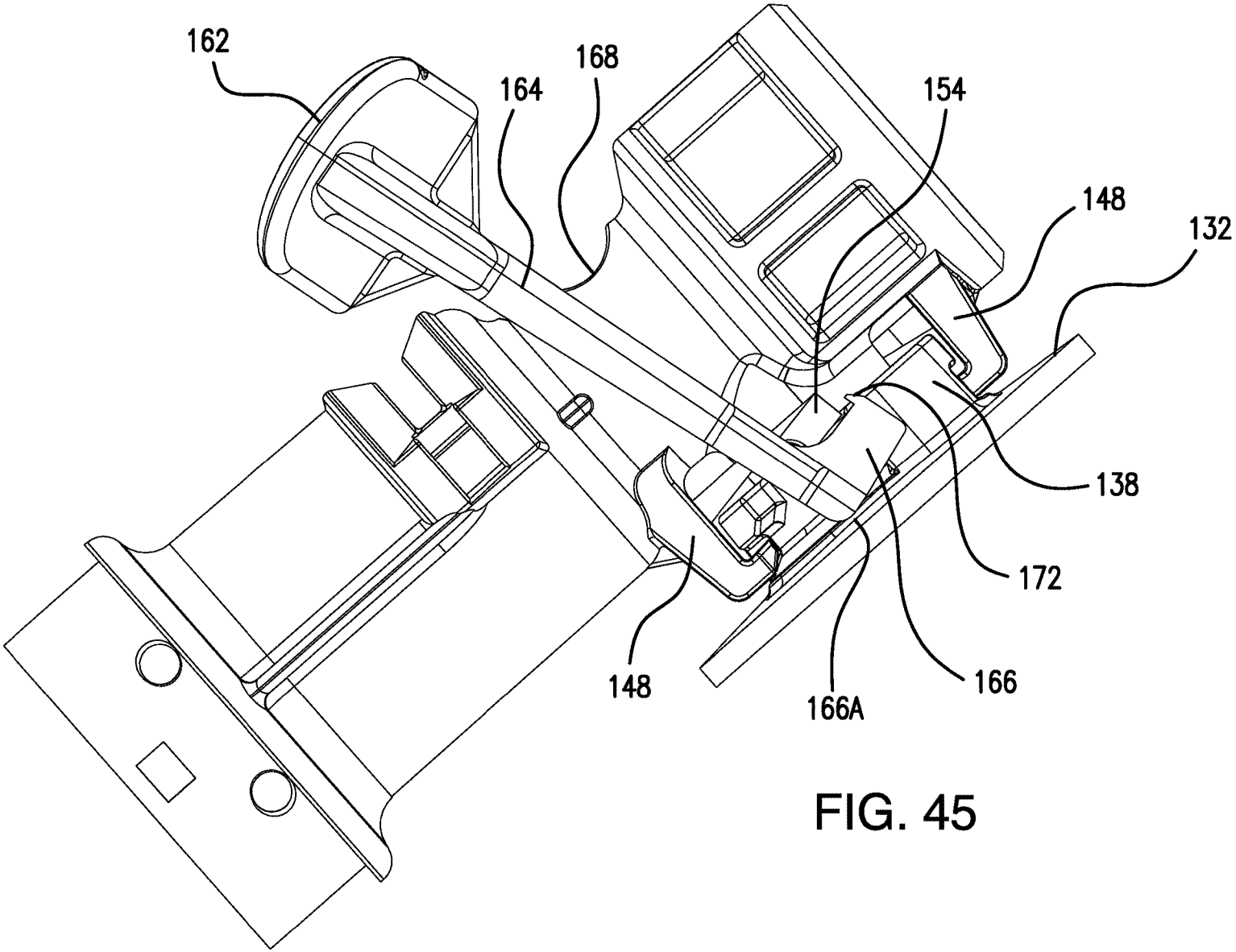
Figure 46:
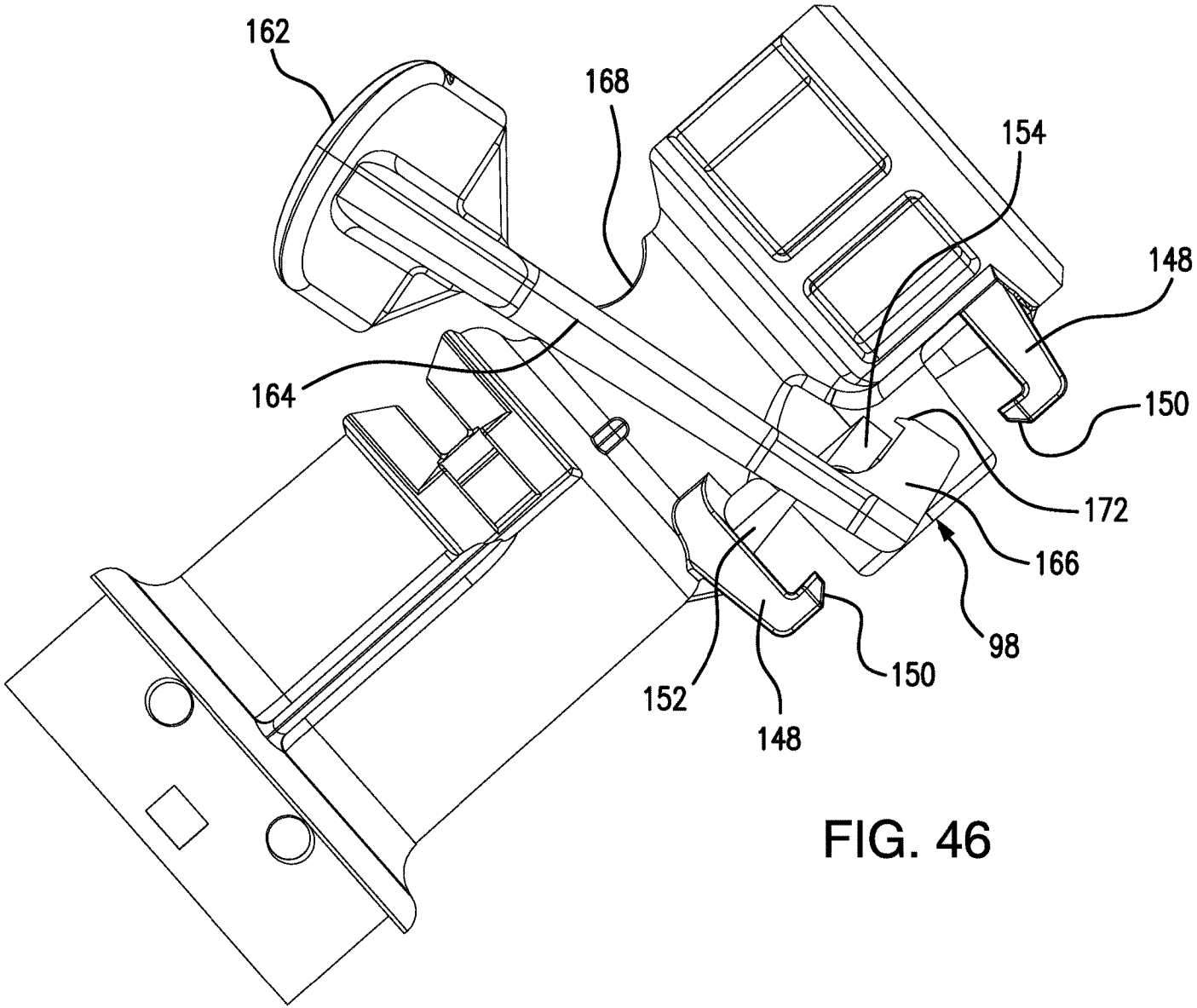
FIG. 46 shows the manifold removed.

After firing or replacing the inflator 10, the spent inflator 10 may be removed by the user through the use of a removal key 160. As shown in FIGS. 42 and 43 corresponding to FIGS. 42-46, the removal key 160 comprises a top portion 162 ergonomically configured to be easily grasped by the user. A pair of legs 164 extend downwardly from the top portion 162. Each leg 164 includes a foot portion 166 extending at a substantially right angle to the leg 164.

To use the removal key 160, the key 160 is inserted by the user around the inflator body 12 with the legs 164 straddling the inflator body 12 and with the foot portions 166 hooking under the respective lock protrusions 154. A large recess 168 is provided on the other side of the inflator body 12 to assure sufficient clearance for the hooking-under. Once hooked under, the removal key 160 is pivoted away from the cartridge end of the inflator 10 such that the heel 166H of the foot 166 fulcrums against the upper surface of the manifold 130 (e.g., the circular flange 132) to lift the lock protrusions 154 upwardly above or level to the upper surface of the wall 138 allowing the key 130 to be counter-rotated by the user.

A small recess 170 may be provided on the other side of the inflator body 12 to retain the now-pivoted key 160. The inflator 10 may be counter-rotated one-eighth of a turn because the lock protrusions 154 are un-snapped from the vertical notch 144. Once counter-turned, the inflator 10 may be removed from the manifold 130.

Each foot portion 166 may optionally include a retention barb 168 extending from the toe end of the foot portion 166 that hooks onto the other side of the lock protrusion 154 to prevent the lock protrusion 154 from inadvertently slipping away from being hooked by the foot portion 166. Finally, while the key 160 of this second embodiment may be removed from a spent inflator 10, the user should nevertheless discard the key 106 with the spent inflator 10.

The present invention includes that contained in the appended claims as well as that of the foregoing description. Although this description has been described in its preferred form with a certain degree of particularity, it should be understood that the present disclosure of the preferred form has been made only by way of example and that numerous changes in the details of construction, combination, or arrangement of parts thereof may be resorted to without departing from the spirit and scope of the invention.

Now that the invention has been described,

What is claimed is:

1. An inflator comprising in combination:

an inflator body having at one end an input for receiving the neck of a gas cartridge;

a manifold assembly intended to be fluidly connected to an inflatable;

a combination automatic and manual actuator assembly including:

a spring-loaded actuator including a pierce pin for fracturing a frangible seal of the gas cartridge;

a bobbin with a dissolvable pill that retains the spring-loaded actuator in a cocked position;

opposing alignment ears extending radially from opposing sides of said actuator that fit into corresponding slots formed in the bobbin to preclude rotational movement of the actuator; and a hood connected onto the end of the inflator body, said hood including an inwardly-extending tab that engages the actuator to securely retain the hood onto the end of the inflator body by means of the inwardly-extending tab being grasped by a forked end of the actuator.

2. The inflator as set forth in claim 1, wherein said tab is engaged by a forked end of the actuator.

3. The inflator as set forth in claim 2, wherein the forked end comprises resilient tines whose ends are notched for engagement onto an inner annular seat formed an annular ring seat.

4. The inflator as set forth in claim 2, wherein upon removal of the hood, the forked end of the actuator releases an annular ring seat allowing the pierce pin of the spring-loaded actuator to fracture the frangible seal of the gas cartridge.

5. The inflator as set forth in claim 4, wherein upon actuation of the actuator, the forked end moves inward to preclude the hood from being reinstalled.

6. The inflator as set forth in claim 1, wherein said hood includes at least one vent hole to allow venting of an area underneath the hood proximate to the bobbin to assure that the bobbin is rapidly flooded upon immersion.

7. The inflator as set forth in claim 1, wherein the hood is colored to indicate an operable condition of the inflator and conceals an end of the inflator body such that when removed, a color indicative of an inoperable condition is revealed.

8. The inflator as set forth in claim 1, wherein the actuator comprises an elongated shaft with an annular ledge having a plurality of radial protuberances to center a spring onto the ledge.

9. The inflator as set forth in claim 8, wherein an outer rim of the ledge includes an integrally-formed protrusion that fits into a slot formed in a lumen of a longitudinal bore of the body.

10. The inflator as set forth in claim 1, further including a window in the inflator body which allows viewing of a color indicative of an operational state of the inflator.

11. The inflator as set forth in claim 10, further including a compressible indicator viewable through the window.

12. The inflator as set forth in claim 11, wherein the compressible indicator is compressed upon the actuator being actuated.

13. The inflator as set forth in claim 11, wherein the compressible indicator seals the window to prevent water from entering the inflator the window.

14. The inflator as set forth in claim 10, further including a see-through lens fitted about the window.

15. The inflator as set forth in claim 14, wherein the lens comprises an arcuate portion that fits over the window to substantially seal therewith.

16. The inflator as set forth in claim 15, wherein the lens is retained in position over the window by opposing arms having protrusions extending into corresponding slots formed in the inflator.

* * * * *